US011052565B2

(12) United States Patent
Strempke et al.

(10) Patent No.: US 11,052,565 B2
(45) Date of Patent: Jul. 6, 2021

(54) PARALLEL GUIDE CUTTING SYSTEM

(71) Applicants: Shelby Strempke, Kelly, IA (US); Paul Eilts, Zearing, IA (US)

(72) Inventors: Shelby Strempke, Kelly, IA (US); Paul Eilts, Zearing, IA (US)

(73) Assignee: KREG ENTERPRISES, INC., Huxley, IA (US)

( * ) Notice: Subject to any disclaimer, the term of this patent is extended or adjusted under 35 U.S.C. 154(b) by 26 days.

(21) Appl. No.: 16/519,238

(22) Filed: Jul. 23, 2019

(65) Prior Publication Data

US 2020/0023541 A1 Jan. 23, 2020

Related U.S. Application Data

(60) Provisional application No. 62/702,114, filed on Jul. 23, 2018.

(51) Int. Cl.
*B27B 27/04* (2006.01)
*B27B 27/10* (2006.01)

(52) U.S. Cl.
CPC ..... *B27B 27/04* (2013.01); *B27B 27/10* (2013.01)

(58) Field of Classification Search
CPC ..... B27B 9/04; B27B 27/04; B27B 27/10; B23D 51/025; G01B 3/1003; G01B 2003/1064; G01B 2003/1066; G01B 3/566; G01B 3/1071; G01B 3/56; G01B 3/1072; G01B 3/1005; G01B 3/1089; G01B 3/1084; B26B 29/06; Y10T 83/8889; Y10T 83/8881; Y10T 83/863; Y10T 83/853; Y10T 83/8878; G10B 2003/1076
USPC .... 83/522.19, 745, 522.15, 454, 455, 467.1, 83/468, 468.1–468.4, 767, 522.11; 33/759, 770, 273, 768, 688, 760, 562, 42, 33/138, 427
See application file for complete search history.

(56) References Cited

U.S. PATENT DOCUMENTS 2,964,848 A * 12/1960 Gonsalves ..... C03B 33/12 33/32.1
4,200,984 A * 5/1980 Fink ..... G01B 3/56 33/427

(Continued)

OTHER PUBLICATIONS

Ron Paulk; Parallel Guides for Festool Track Saw—https://youtu.be/IGFZYEhGNHI Jun. 13, 2015.

(Continued)

*Primary Examiner* — Ghassem Alie
(74) *Attorney, Agent, or Firm* — Christopher A. Proskey; BrownWinick Law Firm

(57) ABSTRACT

A system for cutting wide workpieces is presented having a track that extends a length between opposing ends and extends a width between a cutting edge and a non-cutting edge. One or more measuring bodies are connected to track and include a flexible measuring tape that extends outward from the rear side of the measuring body. The measuring bodies include a locking member that includes an arm connected to a rotating axle having a cam surface that pushes down upon a brake shoe that includes pads formed of a material having a high coefficient of friction that securely holds the measuring tape between the brake shoe on one side and a cradle on the other side. In this way, a system is presented that facilitates quick, easy and repeatable cuts on wide workpieces.

42 Claims, 27 Drawing Sheets

(56) References Cited

U.S. PATENT DOCUMENTS

| | | | | |
|---|---|---|---|---|
| 4,205,448 | A * | 6/1980 | Asai | G01B 3/1005 242/381.3 |
| 4,998,356 | A * | 3/1991 | Chapin | G01B 3/1005 242/381.3 |
| 7,020,978 | B1 * | 4/2006 | Nelson | B43L 13/002 33/760 |
| 8,020,312 | B1 * | 9/2011 | McGahan | B26B 29/06 33/770 |
| 8,464,436 | B2 | 6/2013 | Smith | |
| 9,233,464 | B2 * | 1/2016 | Sherman | B25H 1/0078 |
| 2006/0196072 | A1 * | 9/2006 | Lewis | G01B 3/566 33/760 |
| 2010/0299948 | A1 * | 12/2010 | Choi | G01B 3/1005 33/768 |
| 2015/0362304 | A1 * | 12/2015 | McCallum | G01B 3/1005 33/767 |
| 2017/0322006 | A1 * | 11/2017 | Stewart | G01B 3/1003 |

OTHER PUBLICATIONS

Festool; Parallel Side Fences FS-PA Item No. 495717 Jan. 1, 2018.
Woodpeckers Parallel Guide Sytem—https://www.youtube.com/watch?v=Ue08WvCoBA8 May 5, 2015.
Seneca Woodworking; Parallel Guide System for Festool and Makita Track Saw Guide Rail (without Incra T-Track) Jan. 1, 2018.

* cited by examiner

PARALLEL GUIDE CUTTING SYSTEM

CROSS REFERENCE TO RELATED APPLICATIONS

This application claims benefit of U.S. Provisional Application No. 62/702,114 which was filed on Jul. 23, 2018, the entirety of which is incorporated herein fully by reference.

FIELD OF THE INVENTION

This invention relates to a cutting system. More specifically and without limitation, this invention relates to a system for cutting wide sheets of material using a track and parallel guides.

BACKGROUND OF THE INVENTION

A number of systems and devices have been developed for cutting wood and other materials. Common types of cutting systems include: band saws, circular saws, miter saws and table saws. Each of these saw configurations have their own unique benefits as well as their own unique disadvantages and drawbacks.

Band saws are formed of a rotating saw blade that is formed in the shape of a band. This blade is relatively narrow and therefore band saws are tremendously well suited for cutting intricate shapes or features in both large and small pieces of material. While effective in many applications, band saws suffer from many disadvantages.

Namely, band saws are not well suited for making long straight cuts due to the narrow configuration of the blade. In addition, due to the large blade, band saws are generally large in stature which makes them stationary, and not portable, tools limited to use within the confines of a workshop. In addition, band saw blades are generally expensive. Also, band saws generally have a slow through-put. Another disadvantage of band saws is that the blade can be easily moved by grains in the wood due to the flexible nature and narrow width of the blade, which adds inaccuracy to straight cuts. For these reasons, band saws are not well suited or desirable for many cutting operations or many users.

Table saws are generally formed of a rotating blade that sticks upward from a table top surface. Table saws are generally well suited for making straight cuts in pieces of plank material. While table saws can be used with great precision to make straight cuts, table saws suffer from many disadvantages.

Namely, due to the rotating blade sticking up from the table top surface, table saws have a generally sinister appearance and therefore many users are scared or intimidated by table saws. While some of the bad reputation table saws have is partially fiction, it is true that the exposed blade is very dangerous, especially when used by the novice user. Another disadvantage of table saws is that due to the fact that the blade protrudes from a table-top-like surface, table saws are relatively large, heavy, complicated and expensive devices. Due to their large size, table saws cannot be used in many settings or are not convenient for use in many applications such as on a jobsite as they are not very mobile or easy to set up on-site. Instead, table saws, like band saws, are generally reserved for use within the confines of a workshop. Yet another disadvantage of table saws is that they have a tendency to kick-back material during cutting.

A kick back occurs when a piece of material binds between the rotating blade and a guide surface or when a workpiece begins to twist or rotate while being cut. This often results in the blade pushing, kicking or throwing the workpiece back toward the user, sometimes in a catastrophic manner. Obviously this can be a very dangerous situation, not to mention a very scary one.

Another disadvantage of table saws is that they can be very difficult to use when cutting large sheets of material because the entire piece of material must be moved, not to mention moved in a manner that prevents binding and kick-back. If the piece of material is not precisely moved it can bind on the blade and kick back. Yet another disadvantage of table saws is that they require a lot of skill and experience to fully utilize the table saw in a safe manner. For these reasons, table saws are not well suited or desirable for many cutting operations or many users.

Circular saws are generally formed of a handheld motor connected to a rotating blade. Circular saws are relatively inexpensive, and unlike table saws, circular saws generally have a blade cover that at least tries to protect the user from the blade when not in use. This blade cover provides at least the appearance of safety which makes many users much more comfortable using a circular saw as opposed to a table saw. Also, due to their small size, circular saws are relatively easy to move and operate. In addition, circular saws are easy to transport and therefore circular saws are well suited for job-site use and are not constrained to use only within a workshop.

While circular saws have many advantages, they also have many disadvantages. Namely, due to their small size it is hard to accurately cut small pieces of material with a circular saw. In addition, it is difficult to make a long and straight cut with circular saws. Another disadvantage to circular saws is that the blade guide often gets into the way when a user is attempting to make a cut, which can cause the cutting operation to be less-safe and can cause the cutting operation to be in accurate. Another disadvantage is because the blade rotates upward through the workpiece circular saws tend to cause a great amount of tear out on the upper-positioned surface of the workpiece that is cut.

Miter saws are generally formed of a rotating saw blade that vertically pivots on a hinge and plunges toward a base and into and through a workpiece placed on the base. Miter saws are particularly well suited to make perpendicular cuts in smaller width workpieces that may be anywhere from extremely long to extremely short. Miter saws also angularly pivot so as to facilitate a wide range of angular cuts. Miter saws can be used to make highly precise and repeatable cuts. Miter saws are relatively inexpensive, and unlike table saws, miter saws generally have a blade cover that at least tries to protect the user from the blade. Miter saws are relatively portable.

While miter saws have many advantages, they also have many disadvantages. Namely, miter saws cannot be used for cutting through wide and/or thick workpieces. In addition, it is difficult to see exactly where a cut is going to be made on a workpiece prior to making the cut, which leads to inaccurate cuts as well as delay in making the cuts. That is, there is no easily perceptible indication where the cut is going to be made on the workpiece prior to actually performing the cut. For these and other reasons, despite their advantages, miter saws suffer from many substantial disadvantages and limitations.

As such, the prior art cutting systems suffer from many substantial disadvantages including being: unsafe, inaccurate, large, expensive, hard to use, they have limited accuracy, they are hard to guide, and they form low quality cuts, among many other disadvantages.

Therefore, for all the reasons stated above, and the reasons stated below, there is a need in the art for an improved parallel guide cutting system that is compact in nature and provides accurate cuts on wide sheets of material.

Thus, it is a primary object of the disclosure to provide a parallel guide cutting system and method that improves upon the state of the art.

Another object of the disclosure is to provide a parallel guide cutting system and method that is safe to use.

Yet another object of the disclosure is to provide a parallel guide cutting system and method that is efficient to use.

Another object of the disclosure is to provide a parallel guide cutting system and method that is relatively inexpensive.

Yet another object of the disclosure is to provide a parallel guide cutting system and method that is capable of making long straight cuts.

Another object of the disclosure is to provide a parallel guide cutting system and method that can be used to cut wide sheets of material easily and accurately.

Yet another object of the disclosure is to provide a parallel guide cutting system and method that is accurate.

Another object of the disclosure is to provide a parallel guide cutting system and method that is efficient.

Yet another object of the disclosure is to provide a parallel guide cutting system and method that provides precise alignment.

Another object of the disclosure is to provide a parallel guide cutting system and method that can be used with workpieces with a wide range of thicknesses.

Yet another object of the disclosure is to provide a parallel guide cutting system and method that is easy to learn how to use.

Another object of the disclosure is to provide a parallel guide cutting system and method that is relatively small in size and shape.

Yet another object of the disclosure is to provide a parallel guide cutting system and method that provides the benefits of a circular saw and a table saw in a single device.

Another object of the disclosure is to provide a parallel guide cutting system and method that holds workpieces in a firm and stable manner.

Yet another object of the disclosure is to provide a parallel guide cutting system and method that is easy to set up.

Another object of the disclosure is to provide a parallel guide cutting system and method that is easy to take down.

Yet another object of the disclosure is to provide a parallel guide cutting system and method that is formed of a minimum number of parts.

Another object of the disclosure is to provide a parallel guide cutting system and method that is simple to use.

Yet another object of the disclosure is to provide a parallel guide cutting system and method that is easier to use than prior art systems.

Another object of the disclosure is to provide a parallel guide cutting system and method that is unique.

Yet another object of the disclosure is to provide a parallel guide cutting system and method that collapses and is easy to store.

Another object of the disclosure is to provide a parallel guide cutting system and method that is light weight.

Yet another object of the disclosure is to provide a parallel guide cutting system and method that is high quality.

Another object of the disclosure is to provide a parallel guide cutting system and method that has a robust design.

Yet another object of the disclosure is to provide a parallel guide cutting system and method that has a long useful life.

Another object of the disclosure is to provide a parallel guide cutting system and method that provides accurate and clean cuts.

Yet another object of the disclosure is to provide a parallel guide cutting system and method that helps prevent chip tear-out.

Another object of the disclosure is to provide a parallel guide cutting system and method that is durable.

Yet another object of the disclosure is to provide a parallel guide cutting system and method that saves time.

Another object of the disclosure is to provide a parallel guide cutting system and method that is fun to use.

Yet another object of the disclosure is to provide a parallel guide cutting system and method that can be used with workpieces of practically any material.

Another object of the disclosure is to provide a parallel guide cutting system and method that is easily portable and can be used on a job site.

Yet another object of the disclosure is to provide a parallel guide cutting system and method that makes it easier to measure for cuts on wide workpieces and sheets of material.

Another object of the disclosure is to provide a parallel guide cutting system and method that makes measuring more repeatable than prior art systems.

Yet another object of the disclosure is to provide a parallel guide cutting system and method that reduces or eliminates the need for a helper when making cuts.

Another object of the disclosure is to provide a parallel guide cutting system and method that firmly locks the measuring tape in place so as to allow repeatable cuts.

These and other objects, features, or advantages of the disclosure will become apparent from the specification, figures and claims.

SUMMARY OF THE INVENTION

A system for cutting wide workpieces is presented having a track that extends a length between opposing ends and extends a width between a cutting edge and a non-cutting edge. One or more measuring bodies are connected to a slot adjacent the non-cutting edge that include a flexible measuring tape that extends outward from the rear side of the measuring body. The measuring tape accommodates the width of the track and measuring body and includes an adjustment member that fine-tunes the calibration of the measuring tape to the track to ensure optimum accuracy. The measuring bodies also include a locking member that includes an arm connected to a rotating axle having a cam surface that pushes down upon a brake shoe that includes pads formed of a material having a high coefficient of friction that securely holds the measuring tape between the brake shoe on one side and a cradle on the other side. In this way, a system is presented that facilitates quick, easy and repeatable cuts on wide workpieces.

DETAILED DESCRIPTION OF THE INVENTION

Figure 1:
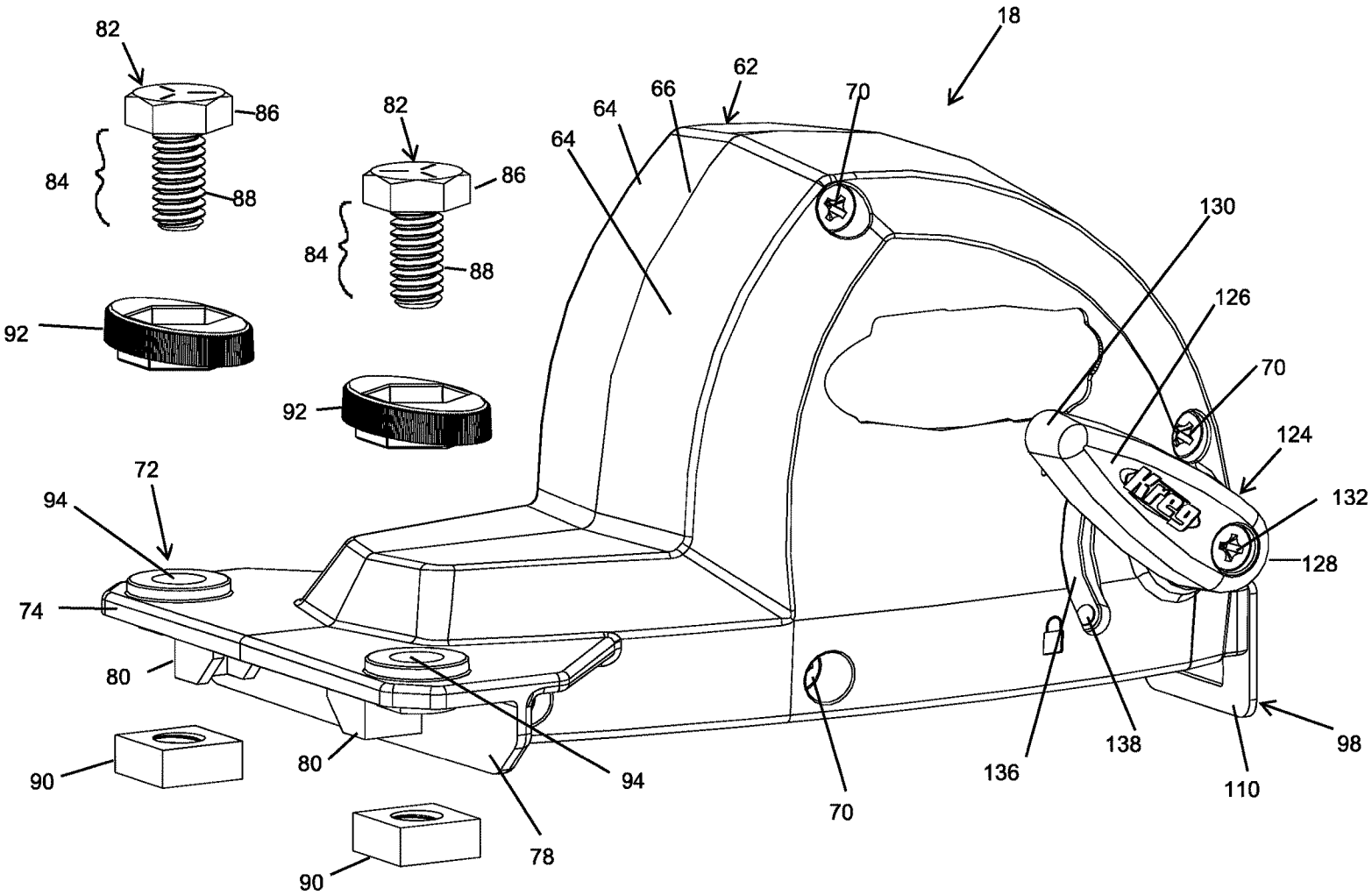
FIG. 1 is a perspective partially exploded view of a measuring body of a parallel guide cutting system.
Figure 2:
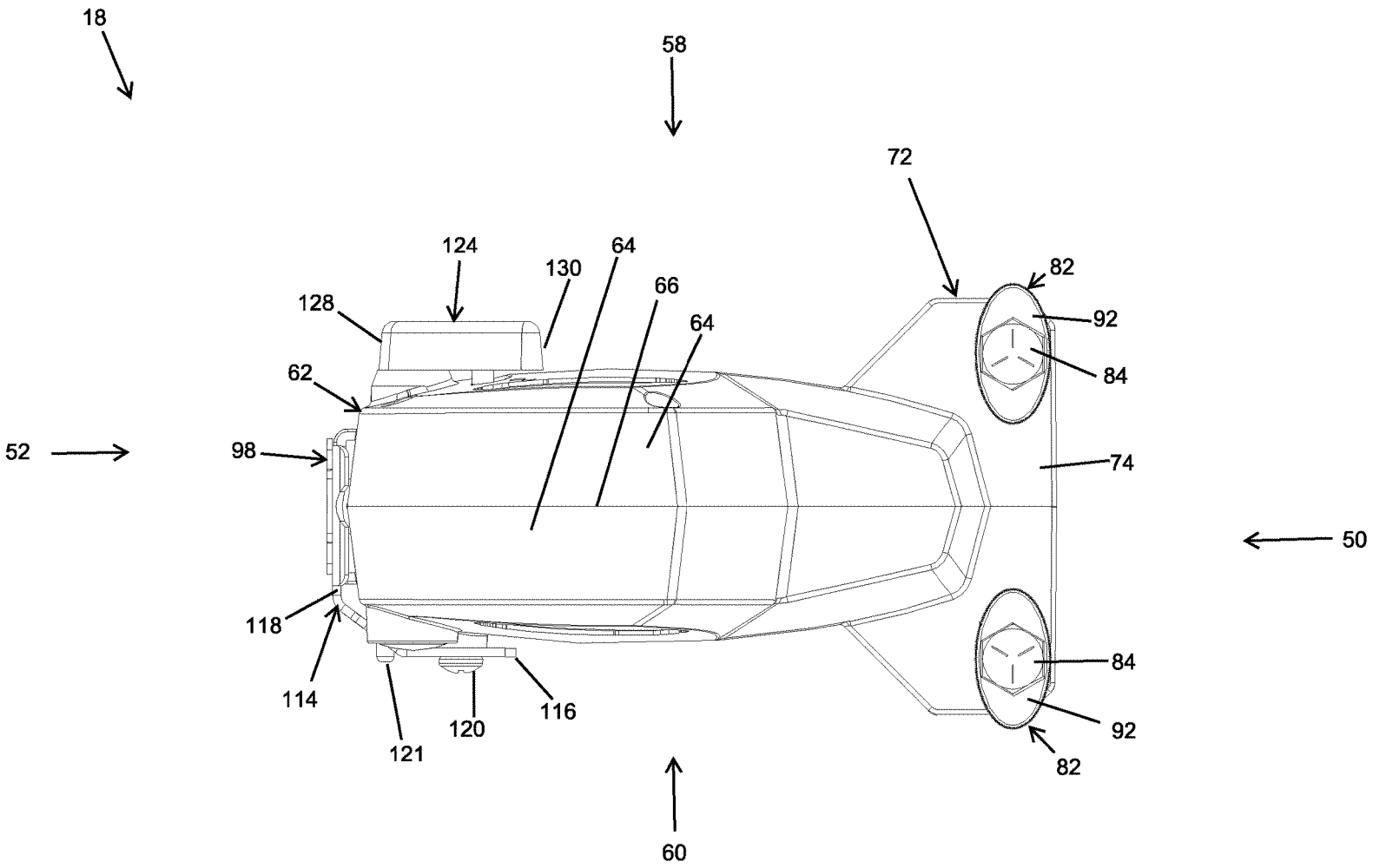
FIG. 2 is an elevation top view of a measuring body of a parallel guide cutting system.
Figure 3:
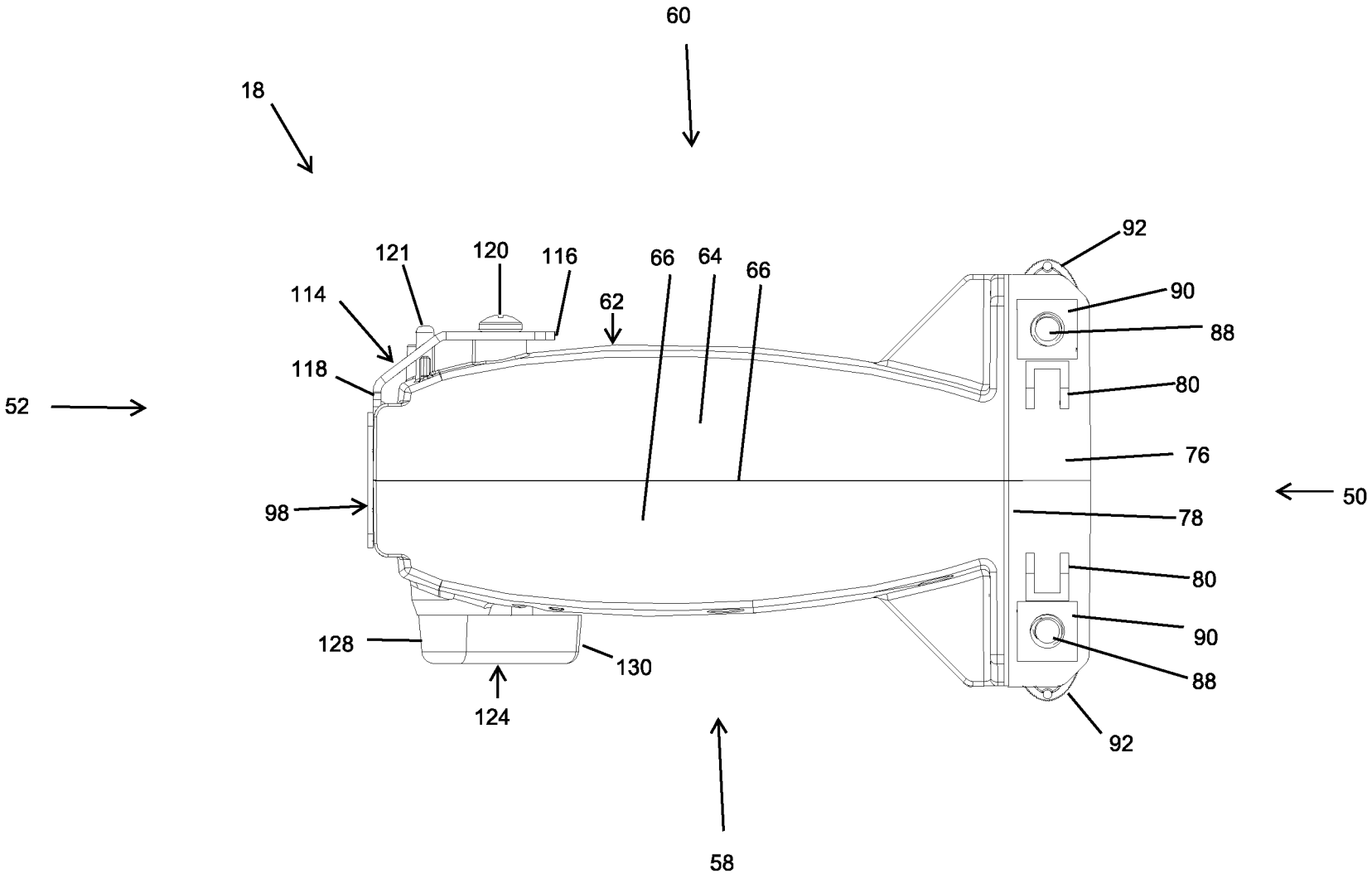
FIG. 3 is an elevation bottom view of a measuring body of a parallel guide cutting system.
Figure 4:
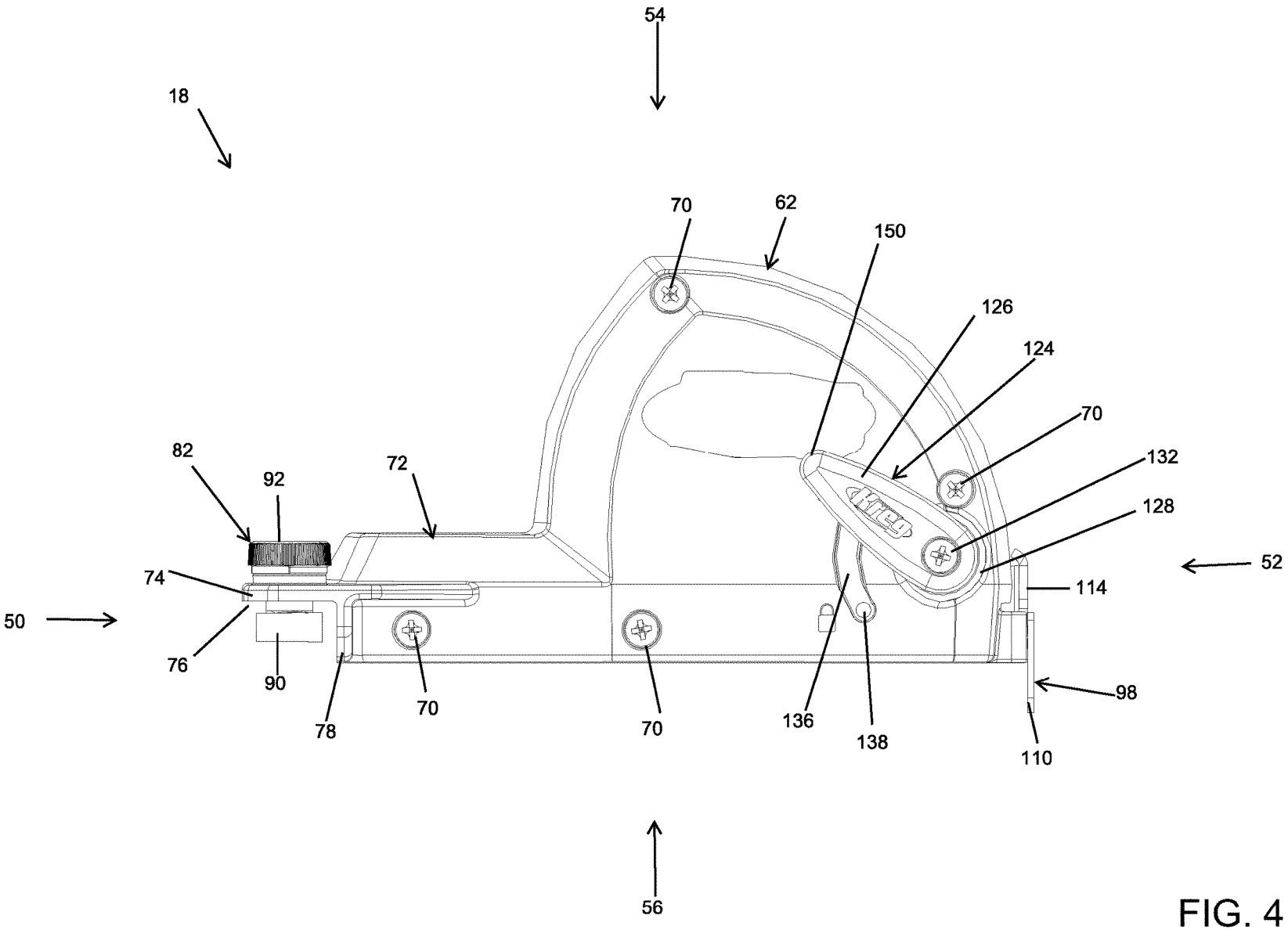
FIG. 4 is an elevation left side view of a measuring body of a parallel guide cutting system.
Figure 5:
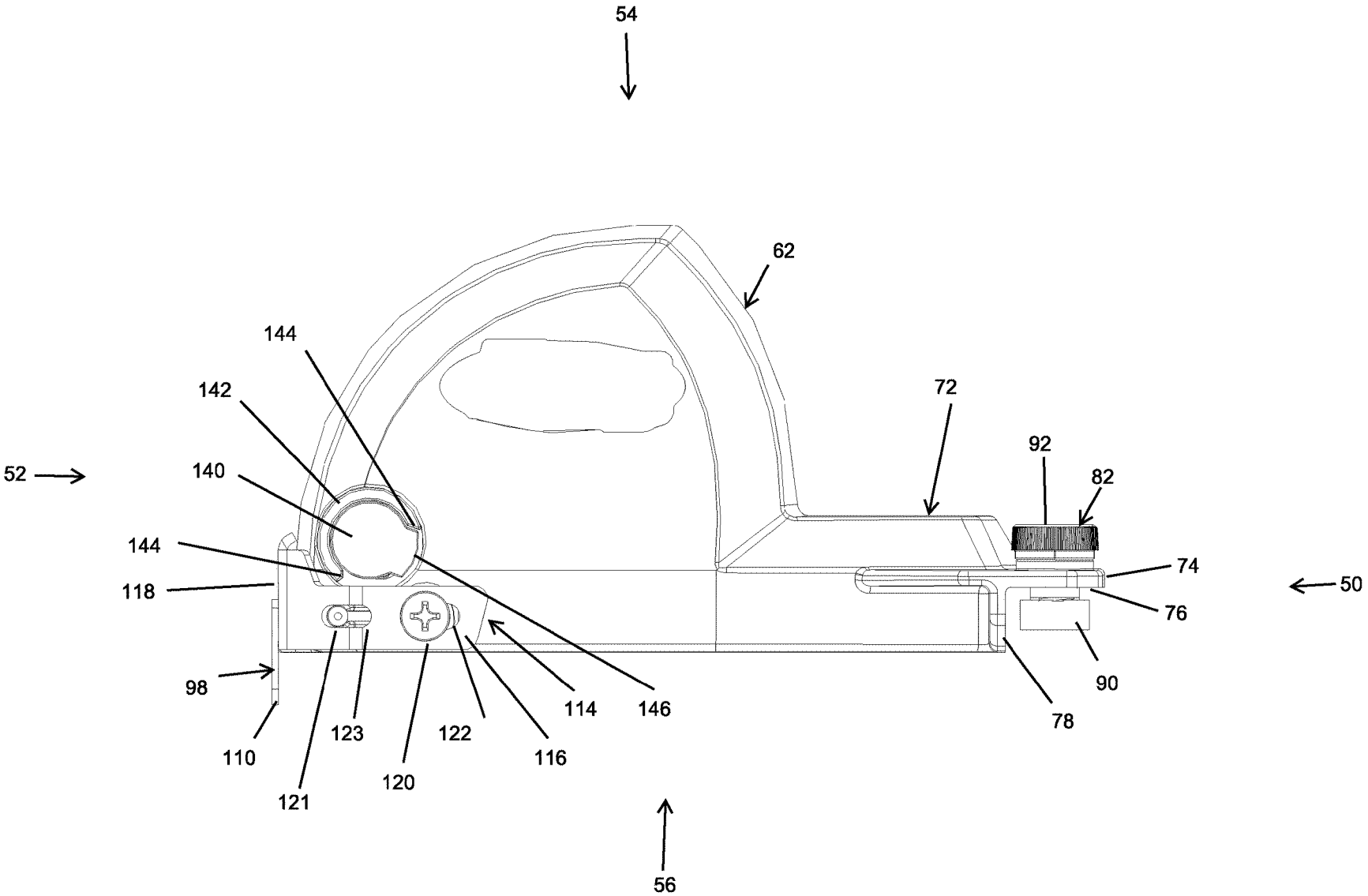
FIG. 5 is an elevation right side view of a measuring body of a parallel guide cutting system.
Figure 6:
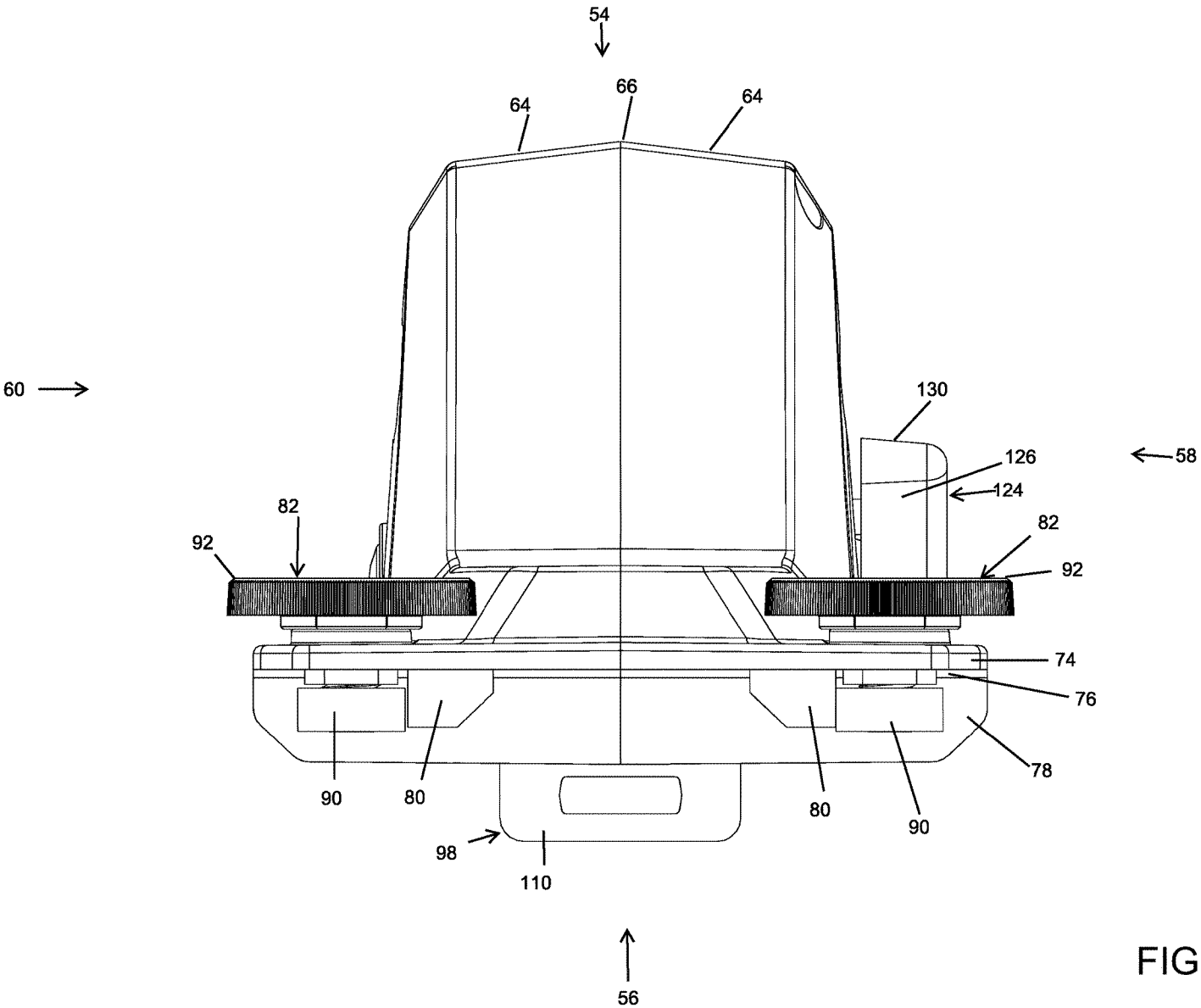
FIG. 6 is an elevation front view of a measuring body of a parallel guide cutting system.
Figure 7:
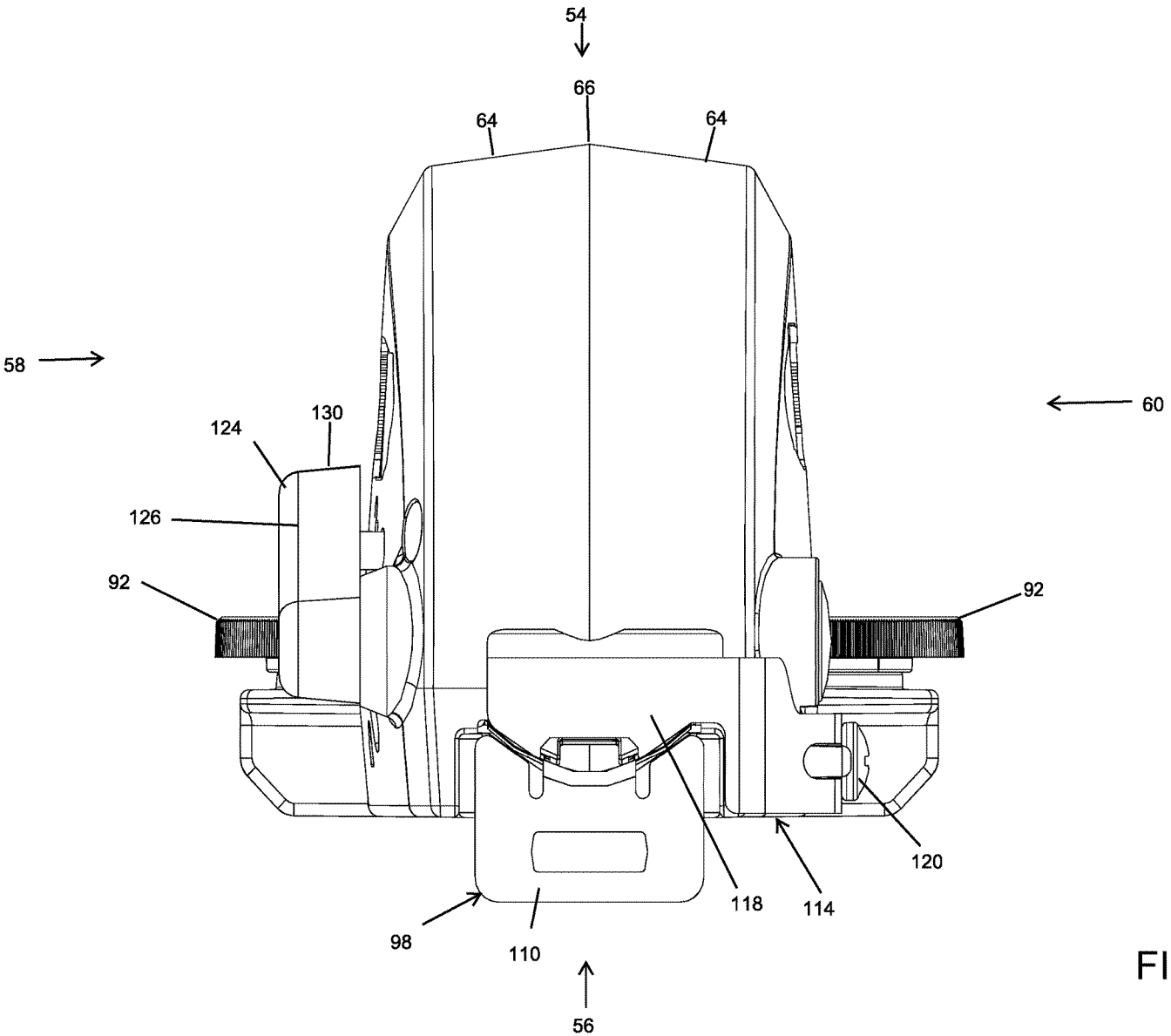
FIG. 7 is an elevation rear view of a measuring body of a parallel guide cutting system.
Figure 8:
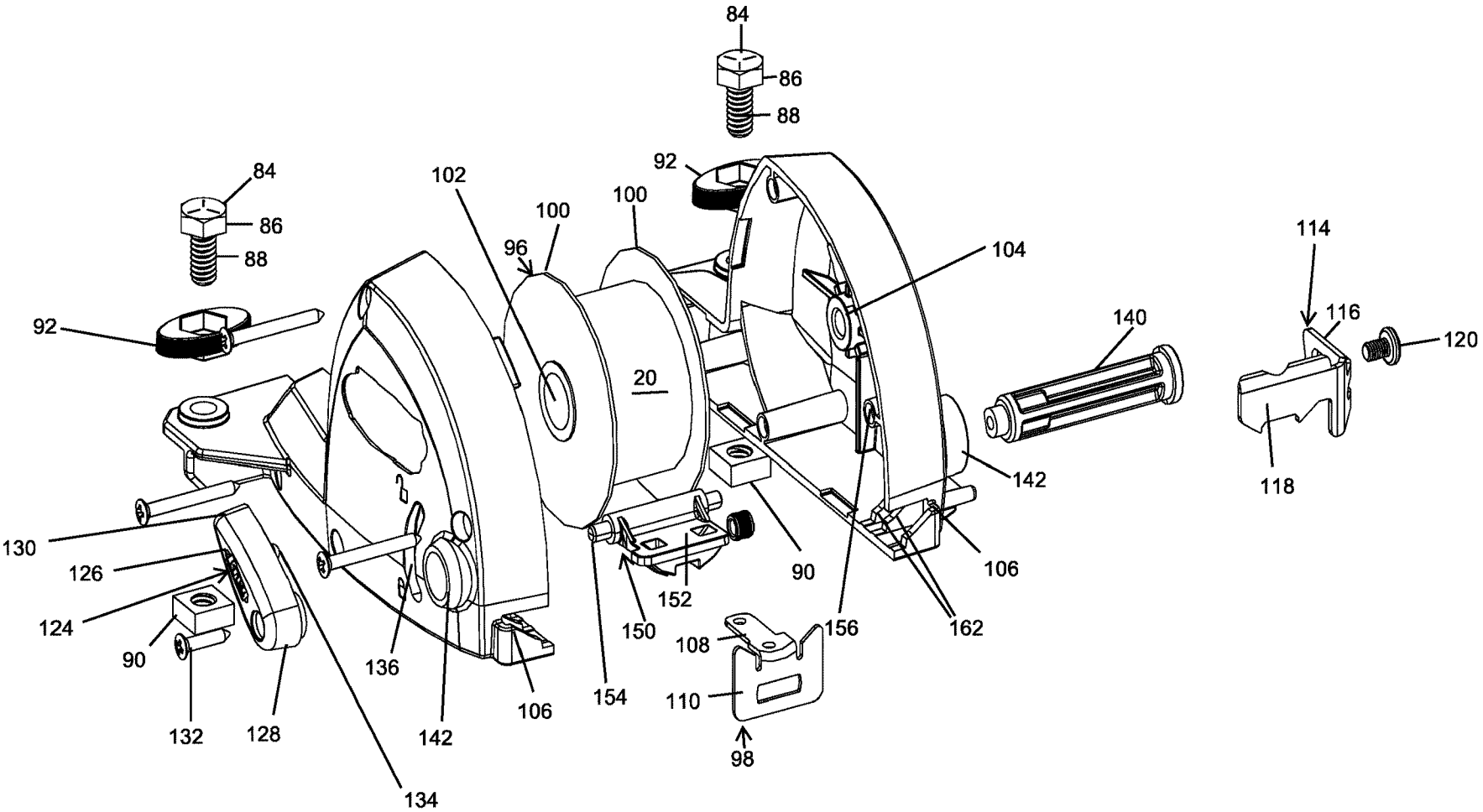
FIG. 8 is a perspective exploded view of a measuring body of a parallel guide cutting system.
Figure 9:
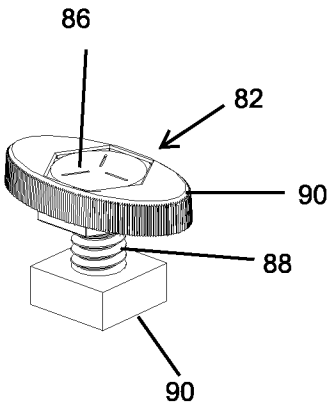
FIG. 9 is a perspective view of components of a measuring body of a parallel guide cutting system, the view showing the housing halves of the measuring body removed.
Figure 9:
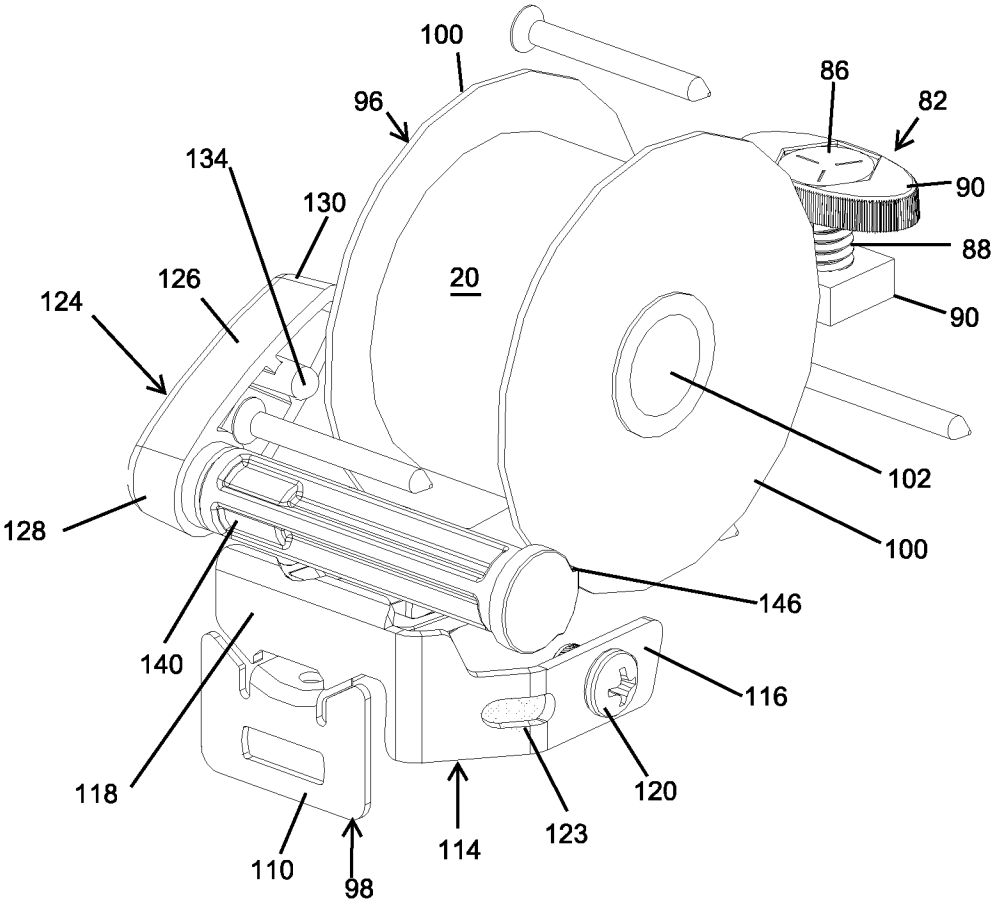
Figure 10:
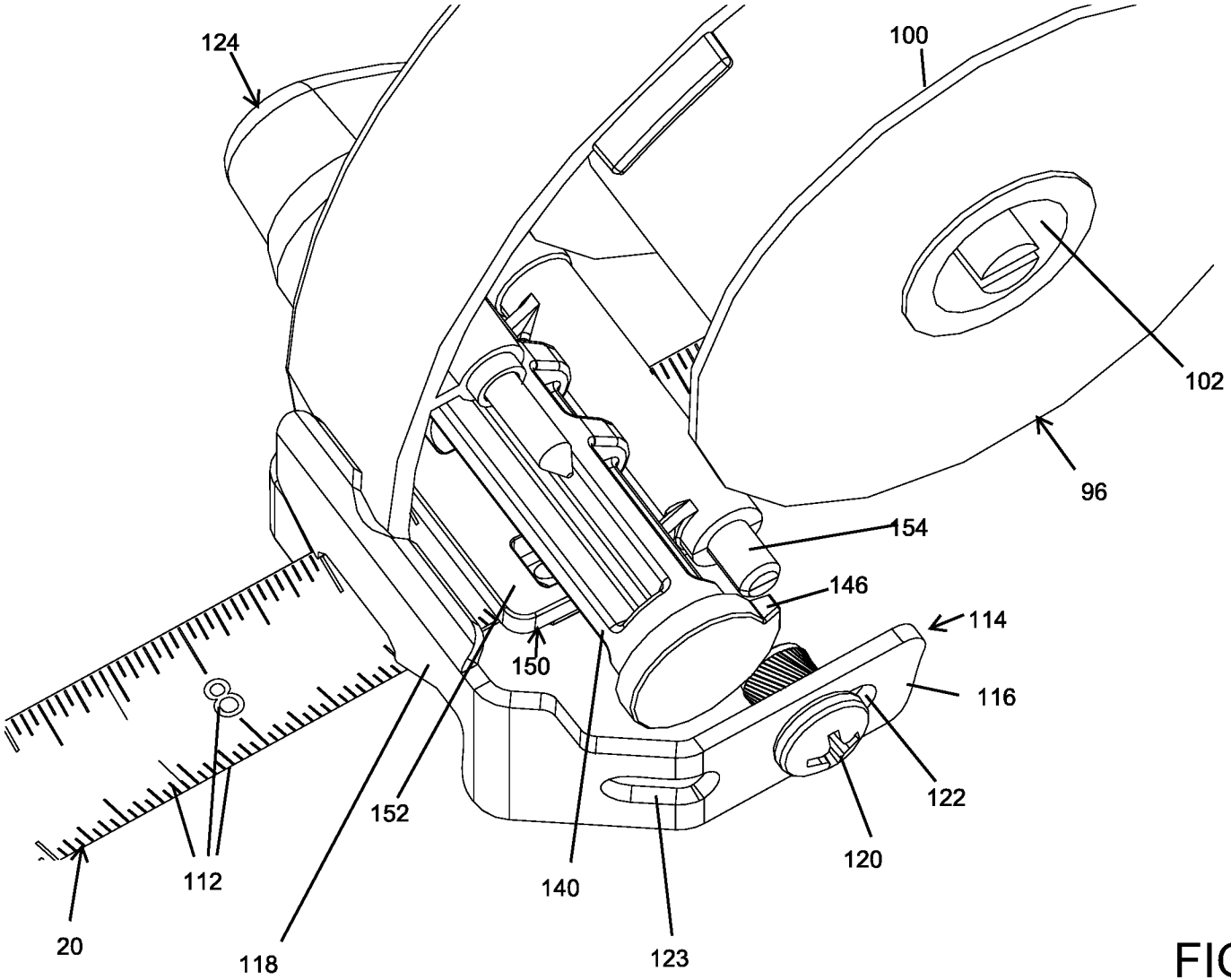
FIG. 10 is a perspective view of a measuring body of a parallel guide cutting system, the view showing a housing half of the measuring body removed.
Figure 11:
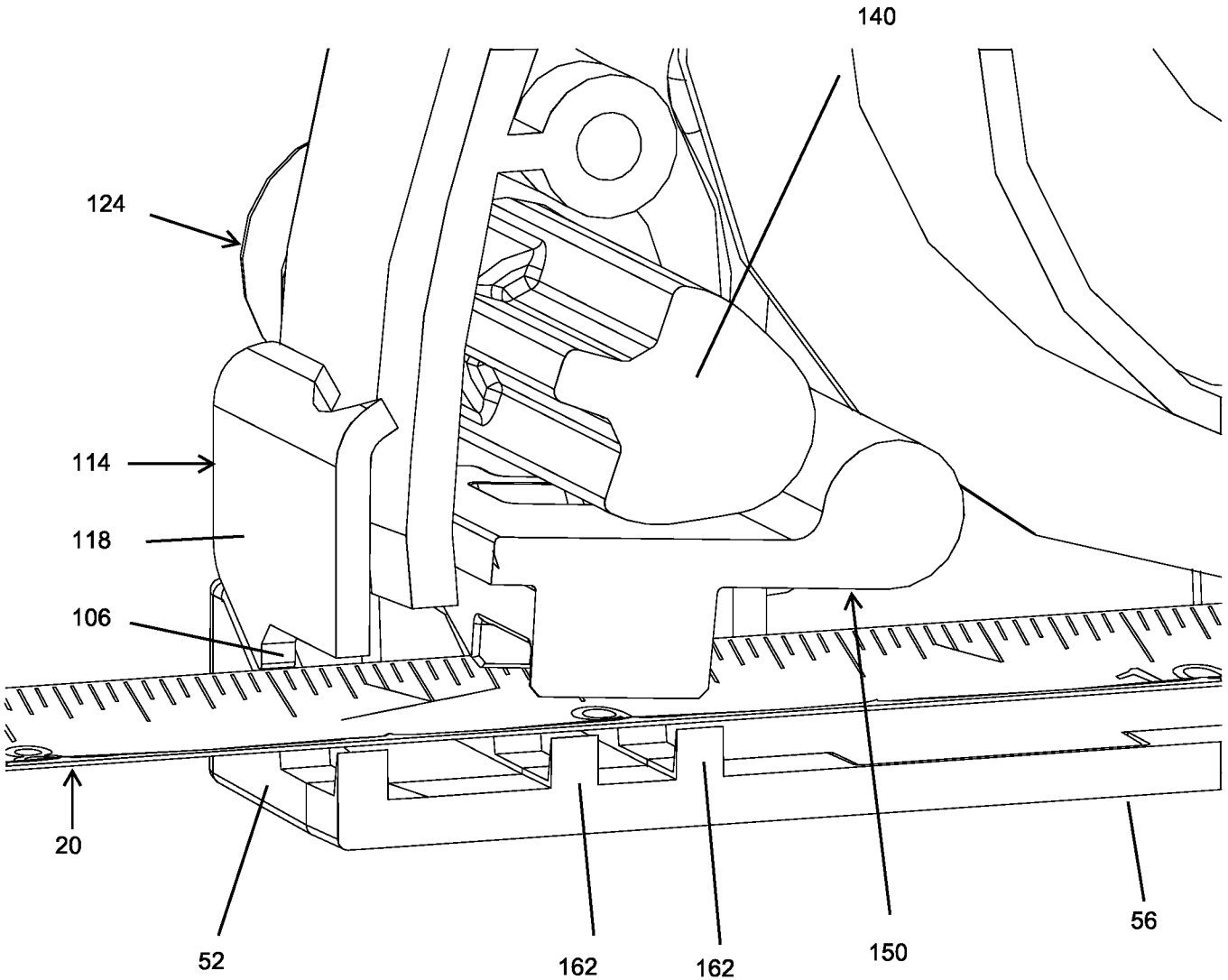
FIG. 11 is a perspective side section view of a measuring body of a parallel guide cutting system, the view showing in particular detail the interaction between the measuring tape, the brake shoe and the locking member.
Figure 12:
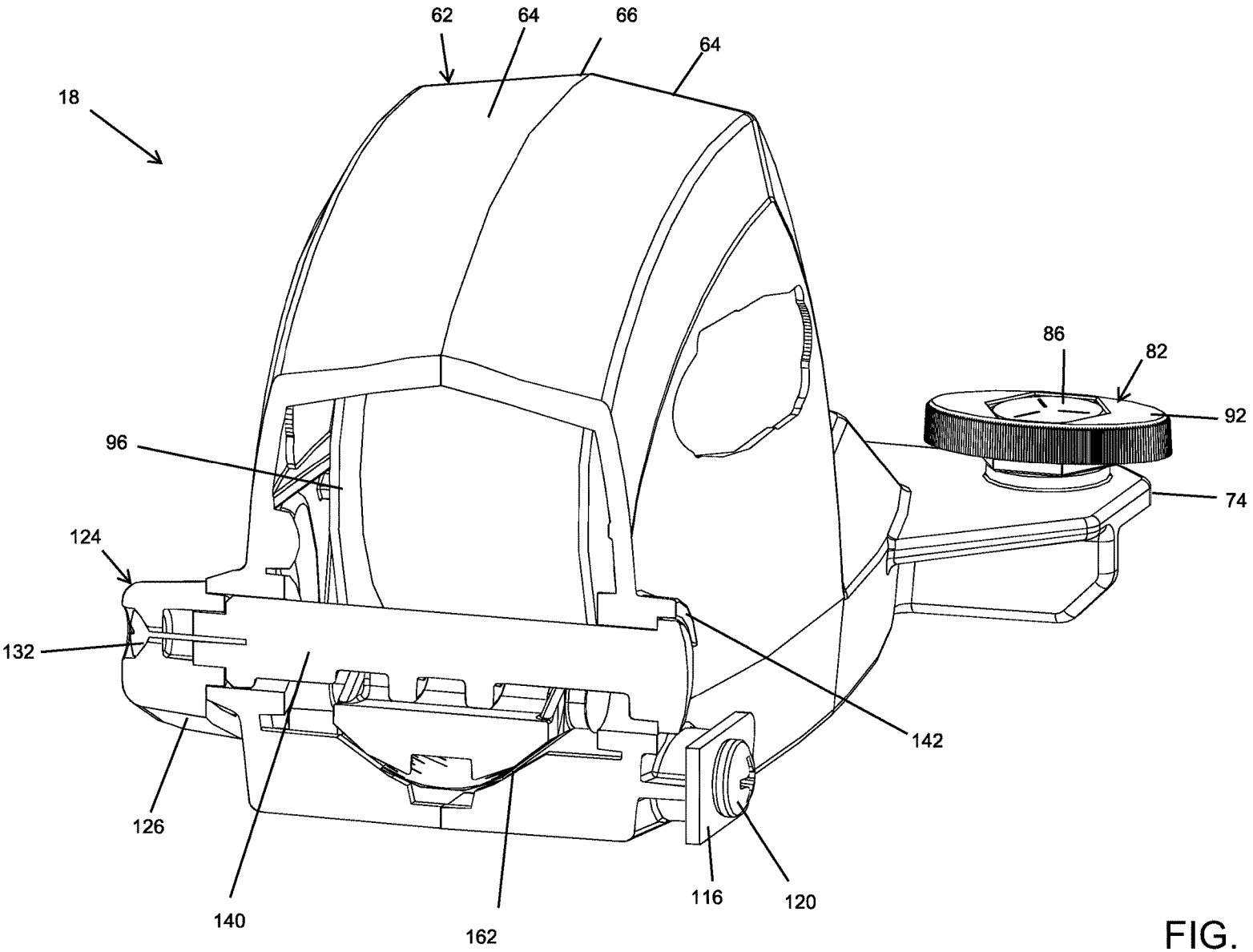
FIG. 12 is a perspective rear section view of a measuring body of a parallel guide cutting system, the view showing in particular detail the interaction between the measuring tape, the brake shoe and the locking member.
Figure 13:
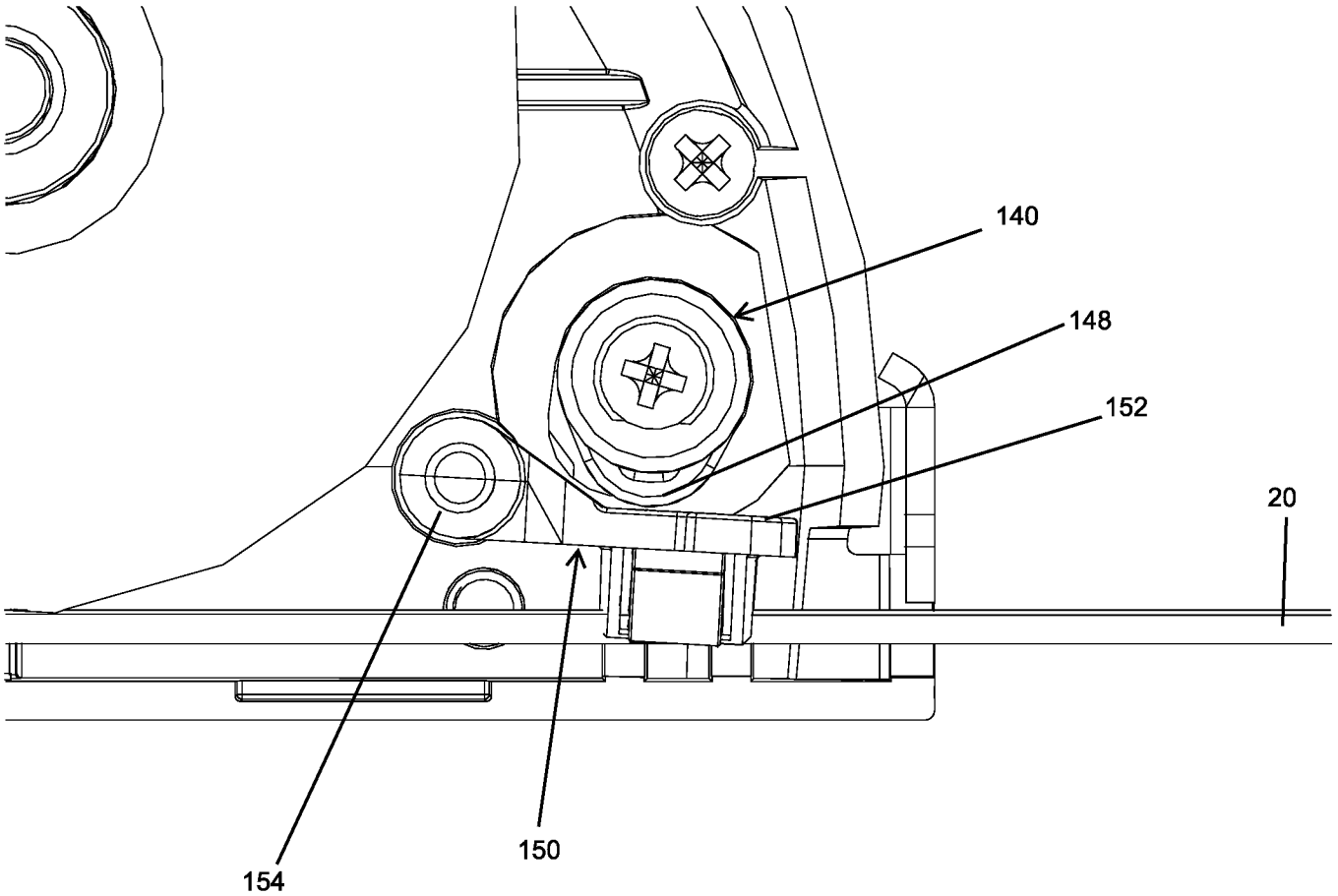
FIG. 13 is an elevation side view of a measuring body of a parallel guide cutting system, the view showing a housing half removed and the view showing in particular detail the interaction between the measuring tape, the brake shoe and the locking member.
Figure 14:
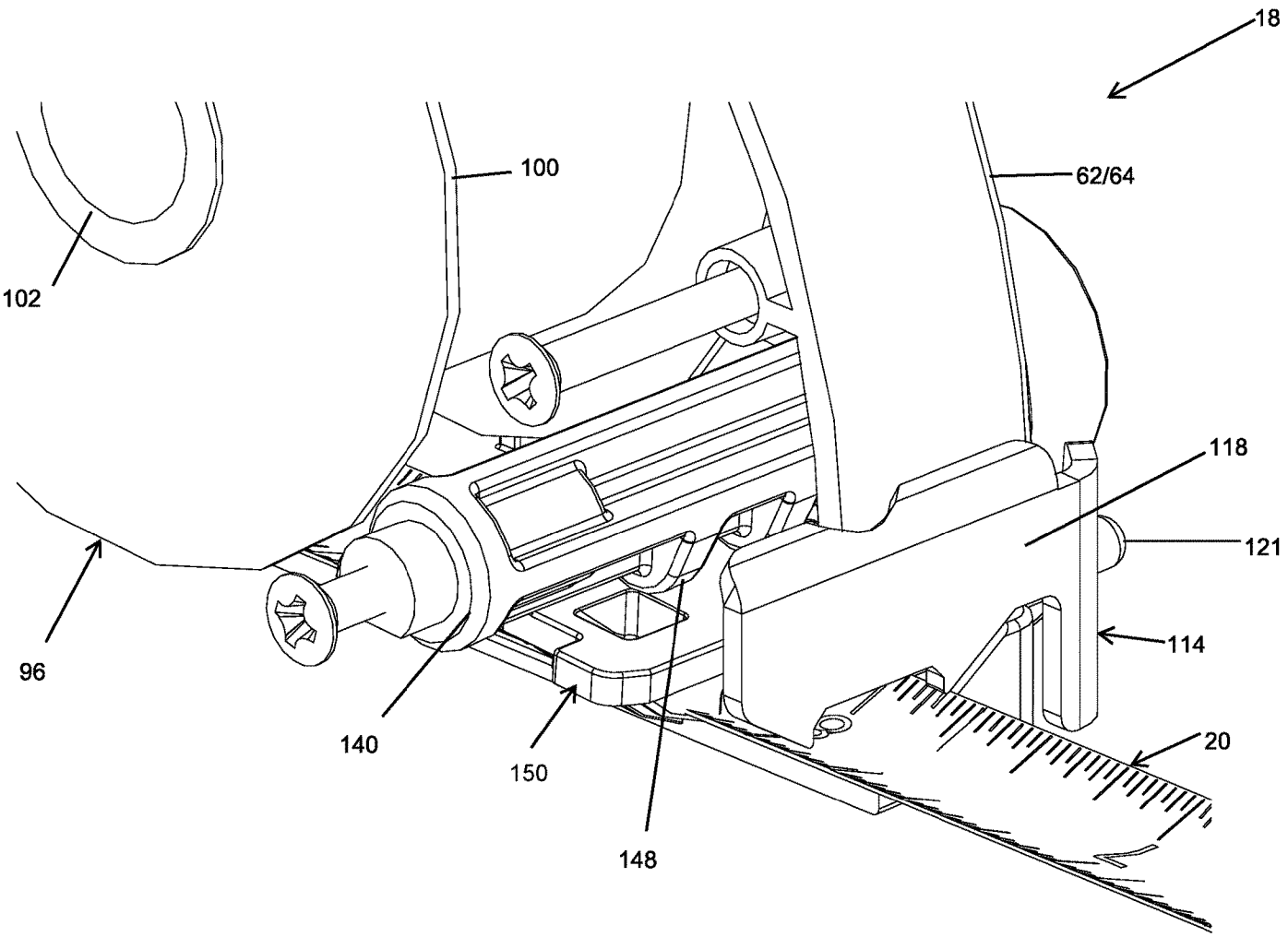
FIG. 14 is a perspective side view of a measuring body of a parallel guide cutting system, the view showing a housing half removed and the view showing in particular detail the interaction between the measuring tape, the brake shoe and the locking member.
Figure 15:
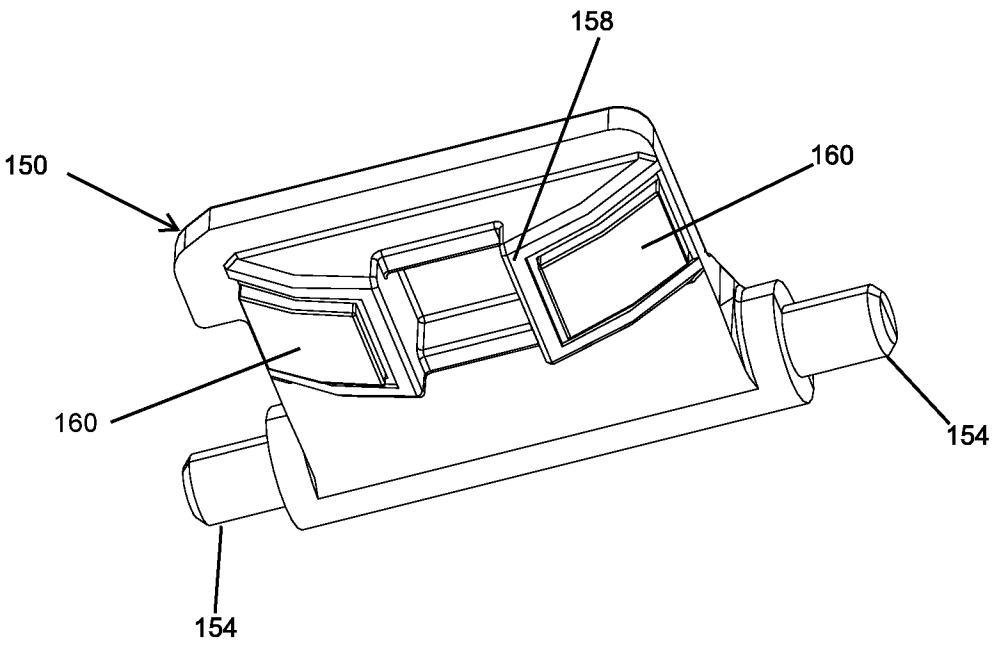
FIG. 15 is an perspective bottom view of a brake shoe of a measuring body of a parallel guide cutting system, the view showing compressible pads having a high coefficient of friction in the lower surface of the brake shoe that are configured to engage and hold measuring tape in place during use.
Figure 16:
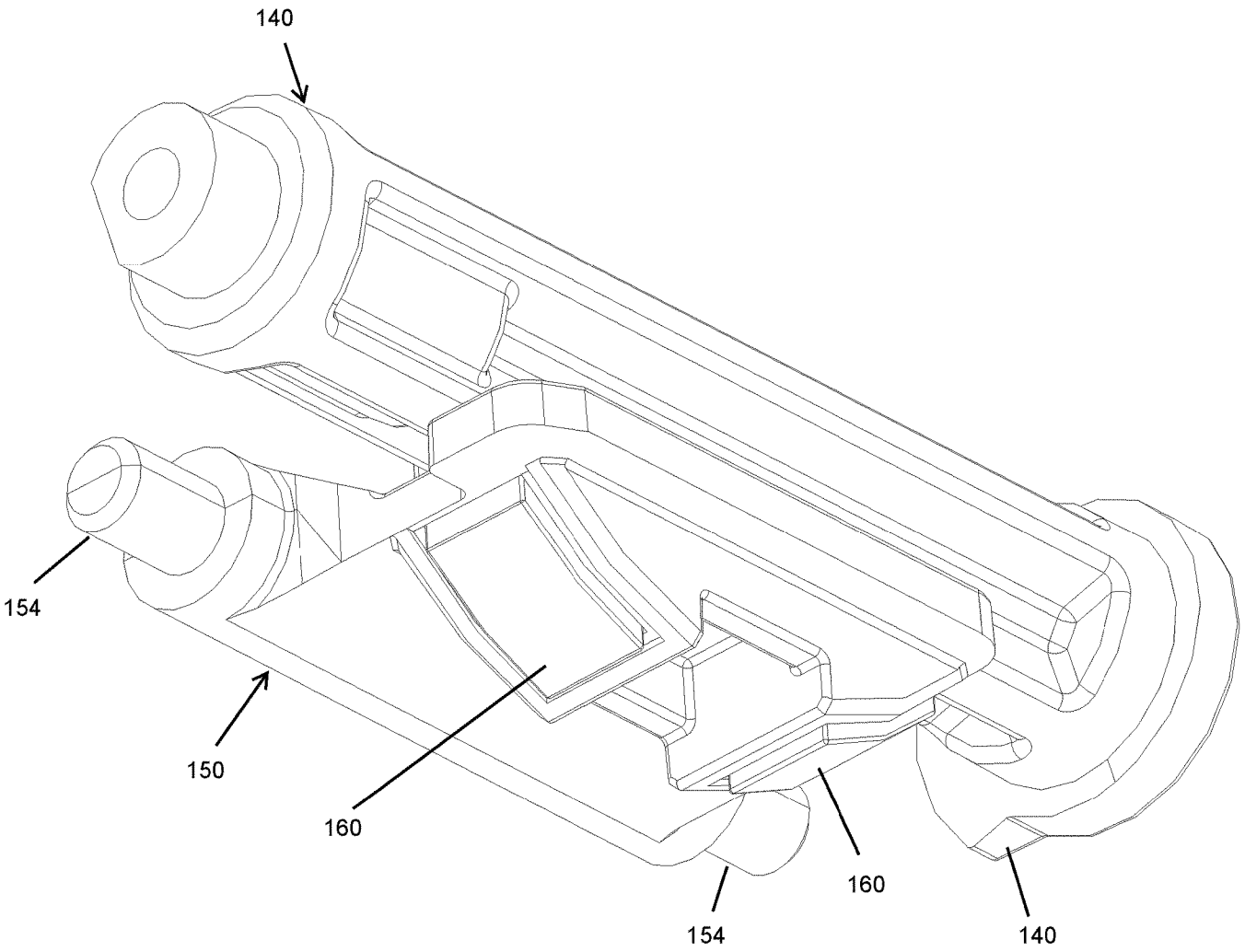
FIG. 16 is another perspective bottom view of a brake shoe along with the axle of a locking member of a measuring body of a parallel guide cutting system, the view showing compressible pads having a high coefficient of friction in the lower surface of the brake shoe that are configured to engage and hold measuring tape in place during use.
Figure 17:
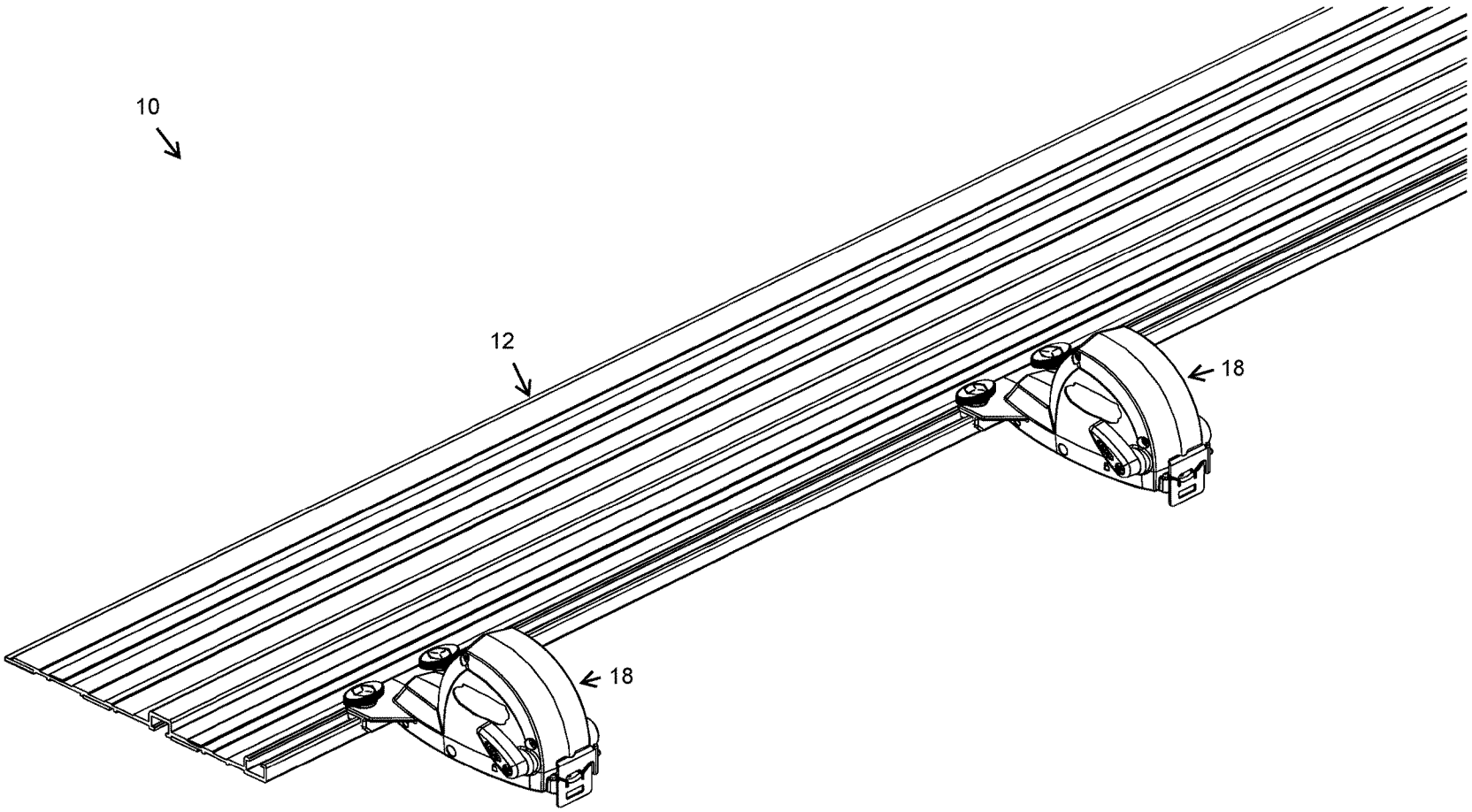
FIG. 17 is a perspective view of a track having a pair of measuring bodies attached adjacent the non-cutting side of the track.
Figure 18:
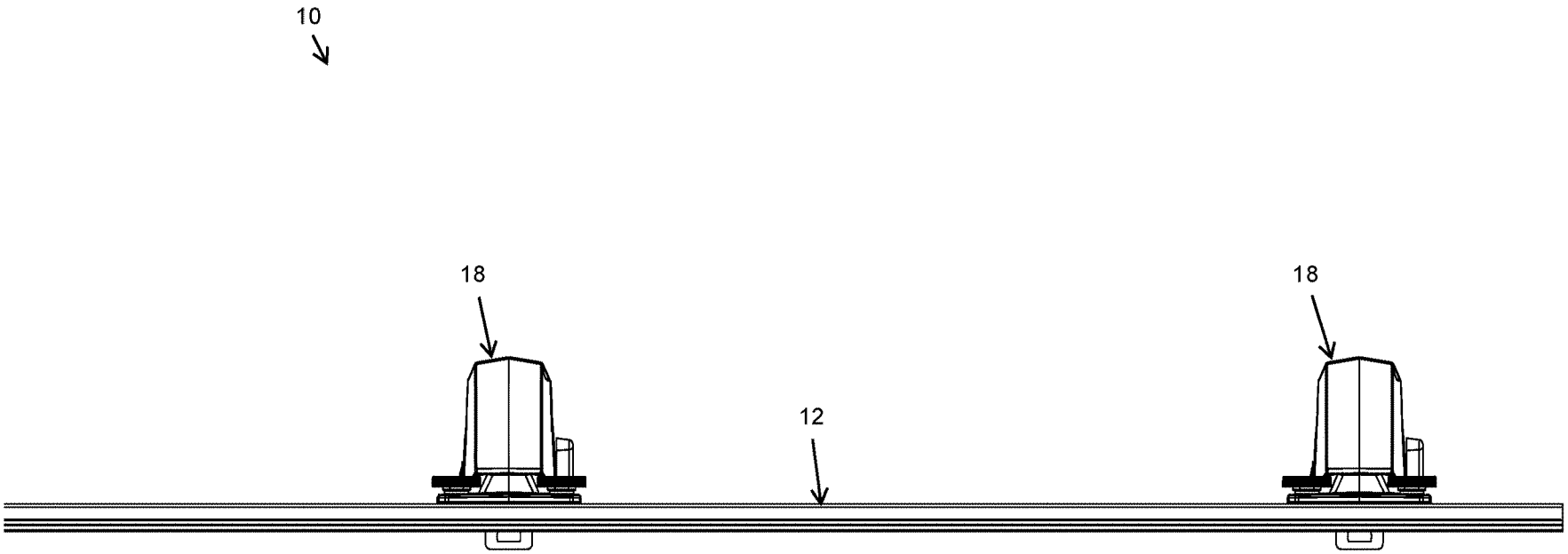
FIG. 18 is an elevation front view of a track having a pair of measuring bodies attached adjacent the non-cutting side of the track.
Figure 19:
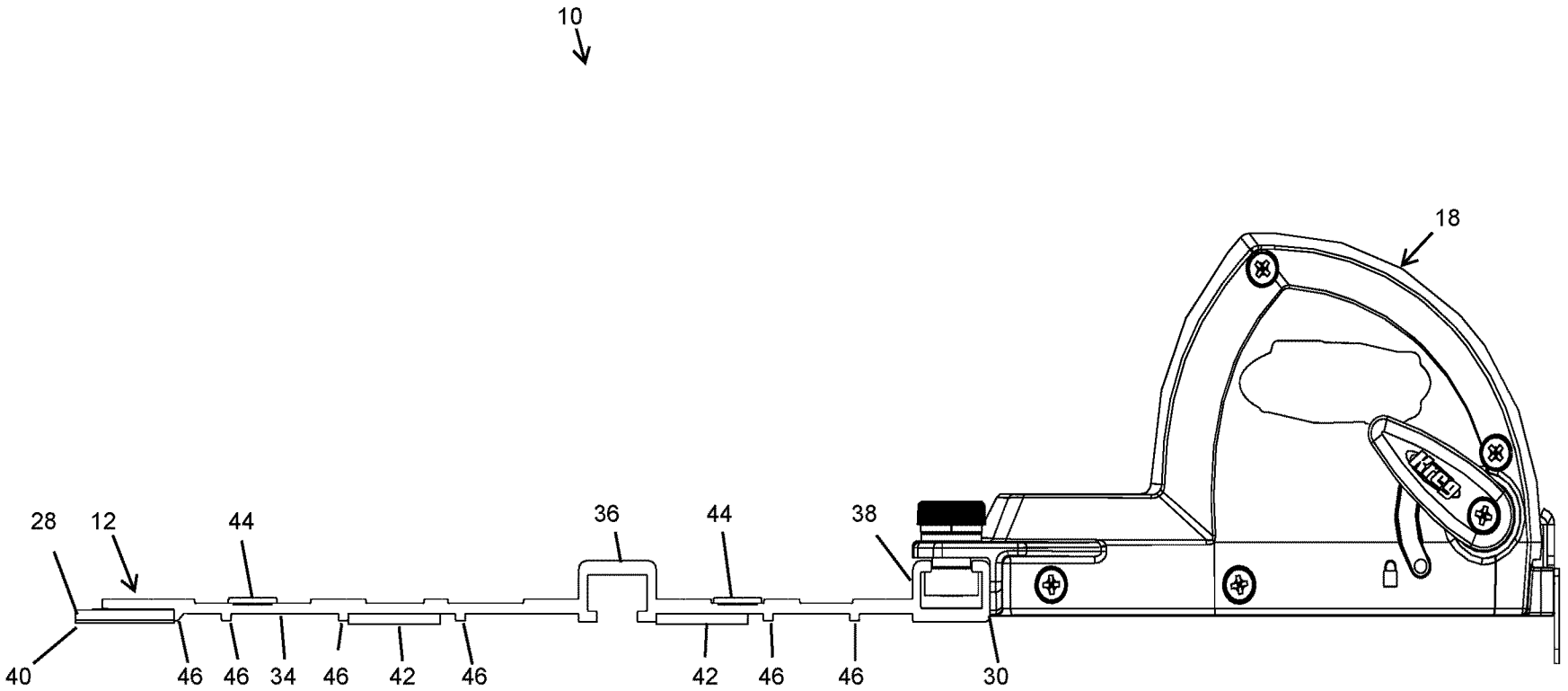
FIG. 19 is an elevation side view of a track having a pair of measuring bodies attached adjacent the non-cutting side of the track.
Figure 20:
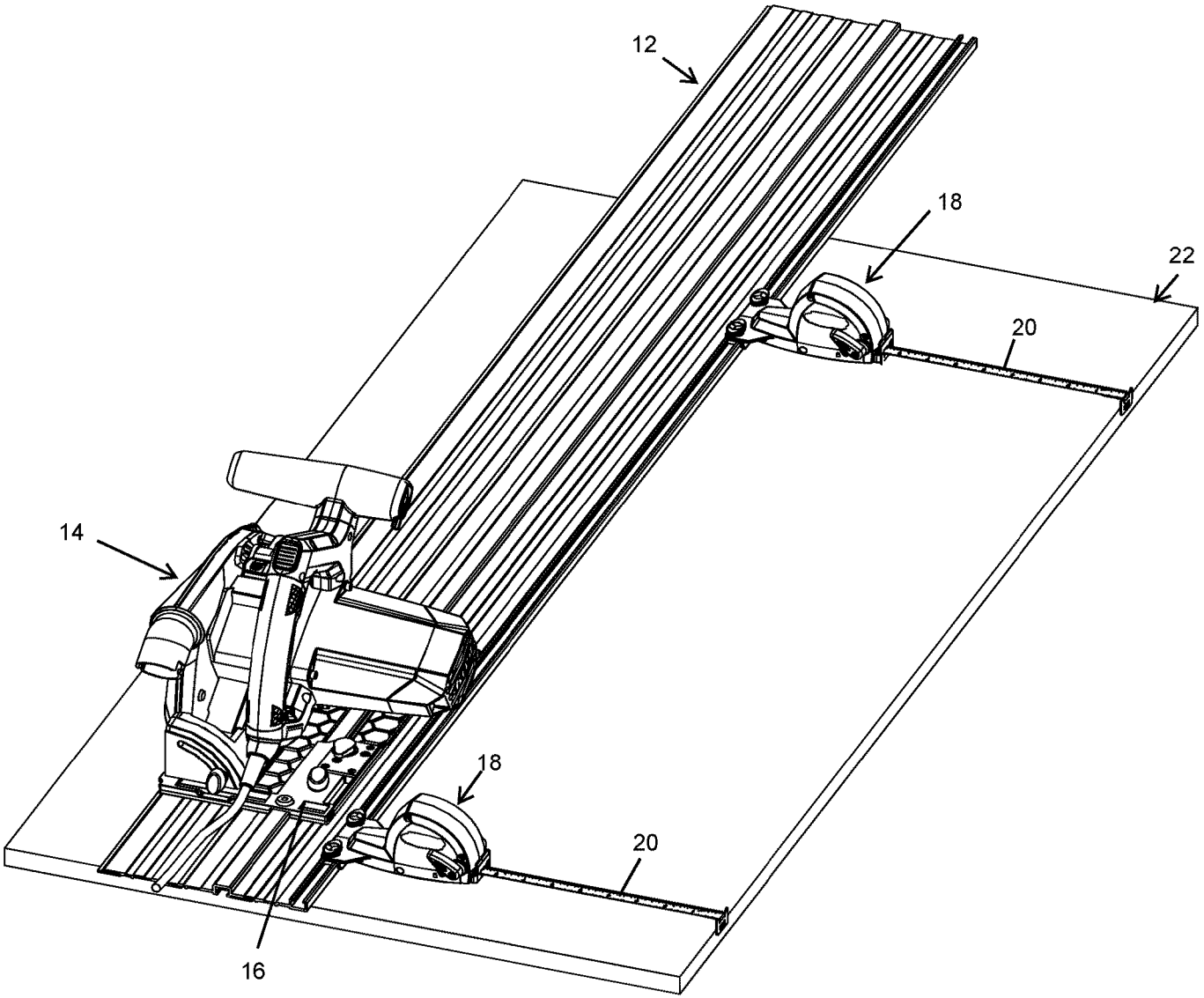
FIG. 20 is a perspective view of a track having a pair of measuring bodies attached adjacent the non-cutting side of the track, the view showing a saw on the track, the view showing a workpiece under the saw and track, the view showing the measuring tapes extended and engaging an edge of the workpiece thereby measuring the cut width distance between the cutting edge of the track and the side of the workpiece opposite the cutting edge of the track.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is, therefore, not to be taken in a limiting sense, and the scope of the invention(s) is defined only by the appended claims, along with the full scope of equivalents to which such claims are entitled.

As used herein, the terminology such as vertical, horizontal, top, bottom, front, back, end, sides, left, right, and the like are referenced according to the views, pieces, parts, components and figures presented. It should be understood, however, that the terms are used only for purposes of description, and are not intended to be used as limitations. Accordingly, orientation of an object or a combination of objects may change without departing from the scope of the invention.

System:

With reference to the figures, a parallel guide cutting system 10 (system 10) is presented. Parallel guide cutting system 10 is formed of any suitable size, shape and design and is configured to facilitate the safe cutting of large workpieces in a quick, easy, safe, accurate and fun manner. In the arrangement shown, as one example, the parallel guide cutting system 10 includes the following component pieces, among others: a track 12, a saw 14 having a guide 16, one or more measuring bodies 18 connected to the track 12 and having a measuring tape 20 that moves between an extended position and a retracted position that is used to measure the width of a workpiece 22 for a cutting operation.

Track:

In one arrangement, system 10 includes a track 12. Track 12 is formed of any suitable size, shape and design and is configured to receive and guide a saw 14 to perform a cutting operation on workpiece 22. In the arrangement shown, as one example, track 12 extends a length between an opposing first end 24 and second end 26 and extends a width between a cutting edge 28 or front edge and a non-cutting edge 30 or rear edge, and includes an upper surface 32 and a lower surface 34. In the arrangement shown, as one example, track 12 is formed of an extruded member, meaning that the features of track 12 extend in a consistent or relatively consistent manner from first end 24 to second end 26.

First Protrusion:

In the arrangement shown, as one example, track 12 has a generally flat upper surface 32 that extends in approximate parallel spaced relation to a generally flat lower surface 34. In one arrangement, to help provide guidance to saw 14 as it slides along the length of track 12, track 12 includes a first protrusion 36 that extends upward from the upper surface 32 a distance, however a recess is also contemplated as is a combination of a protrusion and a recess or multiple protrusions or recesses or any combination thereof. In the arrangement shown, as one example, first protrusion 36 is positioned between the cutting edge 28 and the non-cutting edge 30 of track 12, at or near the middle of track 12. When viewed from an end 24, 26, first protrusion 36 is a generally square or rectangular shaped protrusion that extends upward from the upper surface of track 12. In the arrangement shown, first protrusion 36 forms a downward facing groove, or in the arrangement shown, a T-slot that may be used to receive fasteners or connecting members for connecting tools and accessories or other sections of track to the track 12. First protrusion 36 is configured to be received by a recess in a guide 16 connected to saw 14 such that when saw 14 slides along track 12, the first protrusion 36 is received within the recess in the guide 16 of saw 14 thereby providing precise alignment and guidance to saw 14.

Second Protrusion:

In the arrangement shown, as one example, track 12 includes a second protrusion 38 that, like first protrusion 36, extends upward from the upper surface 32 of track 12 a distance, however a recess is also contemplated as is a combination of a protrusion and a recess or multiple protrusions or recesses or any combination thereof. Second protrusion 38 is positioned at, near or along the non-cutting edge 30 of track 12 and when viewed from an end 24, 26 is a generally square or rectangular protrusion that extends upward from the upper surface 32 of track 12. In the arrangement shown, second protrusion 38 forms an upward facing groove, or in the arrangement shown, a T-slot, that may be used to receive fasteners or connecting members for connecting tools and accessories or other sections of track to the track 12.

While two protrusions (first protrusion 36 and second protrusion 38) are shown extending upward from the upper surface of track 12, any number of protrusions are hereby contemplated for use, such as none, one, three, four, five, six or more; as is any number of recesses, or any combination thereof. In the arrangement where no protrusions are present in track 12, other features may be present such as one or more grooves or recesses in track 12 that receive protrusions in the guide 16 of saw 14 thereby providing guidance and alignment for saw 14.

Chip Strip:

The cutting edge 28 of track 12 includes a chip strip 40. Chip strip 40 is formed of any suitable size, shape and design and is configured to be a consumable edge that is cut to precisely fit the blade of saw 14 during a cutting operation. That is, in one arrangement, to provide durability and rigidity, track 12 is formed of a metallic material such as aluminum or an aluminum alloy or another metallic material. In contrast, chip strip 40 is formed of a plastic or composite or non-metallic material. Chip strip 40 extends past and outward from cutting edge 28 of track 12 a distance. Upon the first cut using saw 14, the chip strip 40 is precisely cut to fit and match the blade of saw 14 with tight and close tolerances. This close fitting arrangement between the blade of saw 14 and the chip strip 40 of track 12 facilitates cutting clean and precise cuts in workpiece 22 and helps to prevent tear out and chipping of the workpiece 22 during cutting.

In one arrangement, when viewed from an end, chip strip 40 is a generally rectangular member that is adhered to the lower surface 34 of track 12 adjacent its cutting edge 28. In one arrangement, as is shown, chip strip 40 extends all or a portion of the length of track 12 from first end 24 to second end 26. In one arrangement, as is shown, chip strip 40 is formed of two layers of non-metallic material. The upper layer is formed of a strong and rigid and hard non-metallic material. This hard material provides strength and rigidity to the chip strip 40. However, harder materials tend to have a lower coefficient of friction, which means that harder materials tend to slide over other objects easier than softer materials. It is undesirable to have chip strip 40 slide on workpiece 22. As such, a lower layer of softer material is placed below the upper layer of a hard material. This lower layer is softer than the upper layer and as such it does not have the strength and rigidity of the upper layer. However, the softer material of the lower layer has a much higher coefficient of friction than the harder upper layer. As such, the addition of the softer lower layer of material of chip strip 40 helps to impart a higher level of friction upon workpiece 22 when track 12 is placed onto workpiece 22. As such, the addition of the softer lower layer of material of chip strip 40 helps to hold a workpiece 22 in place during a cutting operation and helps to prevent a workpiece 22 from moving or shifting during a cutting operation, thereby improving the quality and accuracy of the cuts. Another benefit of having the lower layer of softer material is that it helps impart friction on the workpiece 22 at the point of cutting. That is, the workpiece 22 is held where the cut occurs. In the arrangement shown, the softer lower layer of material of chip strip 40 is much thinner than the harder and more-rigid upper layer of chip strip 40.

Grip Strip:

In one arrangement, to further help hold a workpiece 22 in place, the lower surface 34 of track 12 includes one or more grip strips 42. Grip strips 42 are formed of any suitable size, shape and design and are configured to engage and hold a workpiece 22 in place when track 12 is lowered onto the workpiece 22. In one arrangement, as is shown, grip strips 42 are formed of a compressible material having a high coefficient of friction such as a rubber, a foam, a rubberized foam or any other non-metallic material that has a high coefficient of friction. These grip strips 42 are generally rectangular in shape when viewed from an end and are adhered to the lower surface of track 12 and extend all or a portion of the length of track 12 from first end 24 to second end 26. The presence of grip strips 42 on the lower surface 34 of track 12 helps to impart friction on the workpiece 22 which helps to hold workpiece 22 in place during a cutting operation. Grip strips 42 may be adhered directly to a flat portion of the lower surface 34 of track 12. Alternatively, grip strips 42 may be adhered to a recess or groove in track 12 that is configured to receive grip strips 42.

Glide Strip:

In the arrangement shown, as one example, the upper surface 32 of track 12 includes one or more glide strips 44. Glide strips 44 are formed of any suitable size, shape and design and are configured to facilitate smooth gliding of the guide 16 of saw 14 over the upper surface 32 of track 12. In one arrangement, as is shown, glide strips 44 are formed of a material having a low coefficient of friction. Or, said another way, glide strips 44 are formed of a material that facilitates smooth and easy sliding of the guide 16 of saw 14 along the length of track 12. These glide strips 44 are generally rectangular in shape and are adhered to the upper surface of track 12 and extend all or a portion of the length of track 12 from first end 24 to second end 26. The presence of glide strips 44 on the upper surface 32 of track 12 helps to reduce friction between the guide 16 of saw 14 and the upper surface of track 12. As such, the presence of one or more glide strips 44 helps to make it easier to make a cut using saw 14 and track 12 by reducing the friction between saw 14 and track 12. Glide strips 44 may be adhered directly to a flat portion of the upper surface of track 12. Alternatively, glide strips 44 may be adhered to a recess or groove in track 12 that is configured to receive glide strip 44.

Structural Features:

In the arrangement shown, as one example, in addition to having a generally flat upper surface 32 and a generally flat lower surface 34, and first protrusion 36 and second protrusion 38, track 12 includes any number of other structural features 46 in its upper surface 32, lower surface 34 or any other portion of the track 12. These structural features 46 may recess in or extend upward from the upper surface 323 and lower surface 34 of track 12. The recesses provided by these structural features 46 provides relief for aberrations in the surface of the workpiece as well as provides relief for the inevitable wood chips and other debris that is part of the woodworking process. These structural features 46 also provide additional structural strength and rigidity to track 12, much in the same way that corrugation provides strength to a sheet of metal.

Saw & Guide:

In one arrangement, system 10 includes a saw 14 and guide 16. Saw 14 is formed of any suitable size, shape and design and is configured slide along track 12, with the help and guidance of guide 16 and facilitate cutting of workpiece 22. In the arrangement shown, as one example, saw 14 is a conventional electrically powered circular saw. However, any other form of a saw, or power tool for that matter, is hereby contemplated for use, such as a plunge cut saw, a router, a jigsaw, a grinder, a cutting wheel, or any other tool.

In the arrangement shown, guide 16 is connected to the lower side of saw 14 and facilitates guidance of saw 14 along track 12. Guide 16 is formed of any suitable size, shape and design and is configured engage track 12 in a mating fashion and slide along the length of track 12 while providing precise alignment to saw 14. In the arrangement shown, as one example, guide 16 is a generally rectangular member that is connected to the lower side of saw 14 and includes recesses (or alternatively protrusions) in its lower surface that mate with one or more protrusions 36 (or alternatively recesses) in the upper surface 32 of track 12 thereby providing guiding alignment to saw 14. The extended surface area of the lower side of guide 16 also helps to smooth the sliding of saw 14. In this way, guide 16 provides the interface between track 12 and saw 14, provides precise alignment of the saw 14 relative to the track 12, allows the saw 14 to be placed on the track 12 and removed from the track 12 with ease, and thereby helps form accurate cuts in an easy-to-use manner.

Measuring Bodies:

In one arrangement, system 10 includes one or more measuring bodies 18. Measuring bodies 18 are formed of any suitable size, shape and design and is configured to connect to track 12 and facilitate accurate measuring of wide workpiece 22 while being easily installed, adjusted and removed from track 12 as well as being collapsible in nature and easily portable and easy to store. In the arrangement shown, as one example, measuring bodies have a front side 50, a rear side 52, a top side 54, a bottom side 56, a left side 58 and a right side 60.

Housing:

In the arrangement shown, as one example, measuring bodies 18 include a housing 62 formed of a pair of opposing housing halves 64 that connect to one another along a seamline 66 that extends along the middle of the measuring bodies 18 in a clamshell like manner. When housing halves 64 are connected to one another, housing 62 has an exterior surface and forms a hollow interior 68. In the arrangement shown, as one example, opposing housing halves 64 receive a plurality of fasteners 70 that extend through one housing half 64 and into the other housing half 64, thereby connecting the opposing housing halves 64 together.

In the arrangement shown, when viewed from the side, measuring bodies 18 have a generally flat bottom side 56. In one arrangement, when measuring bodies 18 are connected to track 12, the flat bottom side 56 extends in a generally flat and flush and parallel alignment to the generally flat lower surface 34 of track 12. In this way, when track 12 with attached measuring bodies 18 is placed on a workpiece 22, the lower surface of track 12 and measuring bodies 18 lie in a generally flat and flush engagement with the upper surface of workpiece 22.

Also, in the arrangement shown, when viewed from the side, measuring bodies 18 extend upward and forward from their lower rearward edge in a generally curved manner until reaching a tangent point at its upper most edge at which point the measuring bodies 18 begin to extend downward as they continue to extend forward before terminating or connecting to the rearward upper edge of the connection section 72. The shape of measuring bodies 18 provides adequate space to house the components of measuring bodies 18 within the hollow interior 68 of measuring bodies 18. That is, the large curved section at the rear side 52 of measuring bodies 18 is largely sized and shaped this way for the purpose of housing and holding measuring tape 20 in a coiled arrangement therein, as is further described herein.

Connection Section:

In the arrangement shown, measuring bodies 18 include a connection section 72 positioned at their front side 50. Connection section 72 is formed of any suitable size, shape and design and is configured to facilitate connection to track 12, or more specifically to the upward facing T-slot of the second protrusion 38 adjacent the non-cutting edge 30 of track 12. In the arrangement shown, as one example, when viewed from the side, connection section 72 is generally square or rectangular in shape and has a lower profile than the bulge at the rear side 52 of measuring body 18 that holds measuring tape 20 therein.

In the arrangement shown, as one example, the front side 15 of measuring body 18 includes a flange 74 that is configured to extend over the non-cutting edge 28 of track 12. More specifically, in the arrangement shown, flange 74 includes a generally flat lower surface 76 that is configured to engage the upper surface 32 of track 12 adjacent non-cutting edge 30 in a generally flat and flush manner that allows measuring body 18 to slide along track 12 so as to facilitate quick and easy placement of the measuring body 18 along the length of track 12. In the arrangement, shown, the rearward edge of lower surface 76 connects to a forward surface 78 that, in the arrangement shown, extends in approximate perpendicular alignment to the lower surface 76. Forward surface 78 is configured to engage the rearward surface of track 12 adjacent non-cutting edge 30 in a generally flat and flush manner that allows measuring body 18 to slide along track 12 so as to facilitate quick and easy placement of the measuring body 18 along the length of track 12. In this way, the arrangement of lower surface 76 and forward surface 78 are sized and shaped to receive the upper surface and rearward surface of track 12 in a precise mating arrangement that facilitates precise alignment as well as sliding of the measuring body 18 along the length of track 12.

In the arrangement shown, as one example, the lower surface 76 of flange 74 includes one or more (and in the arrangement shown, two) guides 80. Guides 80 are formed of any suitable size, shape and design and are configured to fit within the T-slot of the second protrusion 38 of track 12 adjacent the non-cutting edge 30. Guides 80 are configured to provide alignment of the measuring body 18 to the track 12 while also allowing the measuring body 18 to slide along the length of track 12. In the arrangement shown, as one example, when viewed from the side, guides 80 have a corresponding width as the upper section of the slot of the T-slot of the second protrusion 38 within close and tight tolerances while also allowing for sliding movement of the measuring body 18. In this way, guides 80 may be inserted within the T-slot of the second protrusion 38 thereby providing alignment of the measuring body 18 to the track 12.

In the arrangement shown, as one example, the flange 74 includes one or more (and in the arrangement shown, two) tightening members 82. Tightening members 82 are formed of any suitable size, shape and design and are configured to facilitate tightening the measuring bodies 18 in place along the length of track 12. In the arrangement shown, as one example, tightening members 82 include a fastener 84 having a head 86 and threaded shaft 88 that connects to a nut 90. Tightening member 82 also includes a knob 92 that facilitates quick and easy manual tightening and loosening. In the arrangement shown, threaded shaft 88 of tightening member 82 extends through a hole 94 in flange 74, which is spaced just outward from a guide 80. In the arrangement shown, threaded shaft 88 extends through hole 94 of flange 74 and connects at its lower end to nut 90. Nut 90 is sized and shaped to fit within the lower, wider, section of the T-slot of second protrusion 38. Nut 90 is sized and shaped to slide along the lower, wider, section of the T-slot of second protrusion 38 while being too large to pull through the upper, narrower, section of the T-slot of second protrusion 38. In this way, when nut 90 is positioned within the lower section of the T-slot of second protrusion 38 and connected to the threaded shaft 88 of tightening member 82 and tightening member 82 is loose, this allows measuring body 18 to slide along the length of track 12. In contrast, when nut 90 is positioned within the lower section of the T-slot of second protrusion 38 and connected to the threaded shaft 88 of tightening member 82 and tightening member 82 is tight, this pulls nut 90 into frictional engagement with the narrower, upper, section of the T-slot of the second protrusion 38 thereby locking the measuring body 18 in place.

In the arrangement shown, as one example, to provide increased alignment and improved sliding of the measuring bodies 18 along the length of track 12, when viewed from above or below, the width of flange 74 and forward surface 78 of connection section 72 is elongated and is wider than the rearward portions of measuring bodies 18. This increased width of flange 74 and forward surface 78 provides increased surface area of the lower surface 76 and forward surface 78 that engages the upper surface 32 of track 12 and the rearward non-cutting edge 30, respectively, which improves sliding and alignment. Improved alignment of the measuring bodies 18 facilitates increased accuracy when cutting workpiece 22.

In the arrangement shown, guides 80 are positioned just inward of the two holes 94. Also, in the arrangement shown, when viewed from below, the guides 80 have generally flat and straight forward and rearward walls that extend in approximate parallel spaced relation to one another, which correspond to the width of the upper portion of the T-slot of the second protrusion 38 of track 12. Also, in the arrangement shown, when viewed from below, the outward facing side of guides 80 extends in a generally perpendicular alignment to the forward and rearward walls of guides 80. When nut 90 is square in shape, or has at least one flat side, perpendicular outward wall of guide 80 engages and aligns nut 90 in the proper alignment to fit within the T-slot of second protrusion 38 of track 12. In the arrangement shown, when viewed from below, guides 80 are generally C-shaped, with the open portion of the C-shape facing one another, and the closed portion of the C-shape facing away from one another.

Measuring Tape:

In the arrangement shown, measuring bodies 18 house and hold a measuring tape 20. Measuring tape 20 is formed of any suitable size, shape and design and is configured to facilitate quick, easy and accurate measurement of the width of workpiece 22 to perform a cutting operation using track 12. In the arrangement shown, as one example, measuring tape 20 is an elongated flexible member that extends an elongated length from an forward end or interior end (not shown), that is connected to a spool 96, to an rearward end or exterior end, that is connected to a stop feature 98. Measuring tape 20 moves between a retracted position, wherein the measuring tape 20 is wrapped around spool 96, and an extended position, wherein measuring tape 20 extends outward from housing 62.

In the arrangement shown, as one example, measuring tape 20, is formed of a flexible metallic material that has a balance of the properties of being flexible, such that it may wrap around spool 96, as well as being rigid, such that it may be self-supporting when it is in an extended position. However any other material is hereby contemplated for use, such as a non-metallic material and/or a combination of metallic material and non-metallic materials. In one when viewed along an extended length, measuring tape 20 takes on an upwardly curved shape. When extended, this upwardly curved shape helps to provide support for the extended length of measuring tape 20 and helps to prevent the extended length of measuring tape 20 from kinking or folding. Being self-supporting when it is extended is convenient as this allows the track 12 with attached measuring tapes 20 to be easily placed upon multiple workpieces 22. That is, it is desirable to be able to lift track 12 up and have measuring tapes 20 remain in an outwardly extending position, as opposed to folding or kinking. To accomplish this, in one arrangement, the strength and thickness of the measuring tape 20 itself is heavier and stronger than conventional the measuring tape of conventional tape measures.

In the arrangement shown, as one example, spool 96 includes a pair of sidewalls 100 that extend around an axle 102 positioned at the middle of spool 96. Measuring tape 20 wraps around axle 102 between opposing sidewalls 100. Spool 96 is itself is connected to axle 104 of housing 62 and rotates upon this connection within the hollow interior 68 of housing 62. In the arrangement shown, measuring tape 20 unwraps off of the lower-forward side of spool 96 and extends rearward out of a slot 106 in the lower end of rear side 52 of housing 62. This arrangement places the measuring tape 20 in alignment with the elongated flat surface of the bottom side 56 of the measuring body 18, and just above the upper surface of a workpiece 22, when the measuring body 18 is placed on the workpiece 22. As such, when track 12 and measuring body 18 are placed on a workpiece 22, and the measuring tape 20 is extended outward from the measuring body 18, the measuring tape 18 extends in approximate parallel spaced alignment to the upper surface of the workpiece 22 with minimal spacing between the measuring tape 20 and the workpiece 22 which maximizes the accuracy of the measurement.

The rear ward end of measuring tape 20 includes a stop feature 98. Stop feature 98 is formed of any suitable size, shape and design and is configured to engage an edge of a workpiece 22 so as to properly index the width of the workpiece 22 for precise measurement. Stop feature 98 also prevents measuring tape 20 from extending through slot 106 of housing 62. In the arrangement shown, as one example, stop feature 98, when viewed from the side includes an upper section 108 and a lower section 110 which extend in approximate perpendicular alignment to one another. In the arrangement shown, as one example, upper section 108 extends along and is affixed to the end of measuring tape 20 and the lower section 108 is configured to engage the edge of a workpiece 22. In one arrangement, upper section 108 is affixed to measuring tape 20 in a non-movable manner, which is in contrast to the movable stop feature of most tape measures. This is because conventional tape measures are configured to be used both in an inside measurement as well as an outside measurement, hence the end of the tape measure must move to accommodate the thickness of the stop feature. However, in the arrangement presented, the measuring tape 20 is configured to be used in an outside-measurement manner only and as such, to ensure optimum accuracy, stop feature 98 is affixed in a non-movable manner.

In the arrangement shown, as one example, the upper surface of measuring tape 20 includes indicia 112. Indicia 112 are any markings or other visual indications that indicate the length or width of the measurement. In one arrangement, indicia 112 may include numbers as well as hash-marks that indicate portions of number. When using the imperial system, indicia 112 may include markings such as 1 inch, ½ inch, ⅓ inch, ¼ inch, ⅛ inch, and 1/16 inch, or any other marking; when using the metric system markings may include centimeter markings, as well as every tenth of a centimeter. In one arrangement, one side of measuring tape 20 includes imperial markings and the other side of the measuring tape 20 includes metric markings. Any other form of markings are hereby contemplated for use as indicia 112.

In one arrangement, indicia 112 accommodate the length or distance between the cutting edge 28 of track 12 and the rear side 52 of measuring body 18. That is, the markings of indicia 112 begin at or around the width of track 12 plus the width of measuring body 18 and as the measuring tape 20 is pulled further out of housing 62 the indicia 112 numbers increase. As such, when measuring tape 20 is pulled out of measuring body 18, measuring tape 18 accurately reads the width of the cut that would be made using the track 12 with attached measuring bodies 18. As such, the indicia 112 at the rearward end of measuring tape 20 begins at several inches (again which is the width of track 12 plus the width of measuring body 18).

This renders measuring body 18 utterly useless as a standalone tape measure when it is not used in association with track 12. However, starting indicia 112 of measuring tape 20 at the width of track 12 and measuring body 18 allows the end of the measuring tape connected to stop feature 98 to be connected to workpiece 22. This also allows for the measurement reading to be made at the rearward edge or rear side 52 of measuring body 18. Measuring the width of a cut at the rear side 52 of measuring body 18 is desirable as it is convenient for the user as the user must be near the track 12 during a cutting operation. Also, this arrangement is desirable as this means that only the stop feature 98 is positioned at the rear-most end of measuring tape 20. While indicia 112 begins at the combined width of track 12 and measuring body 18, adjustment is required to precisely calibrate measuring body 18 to track 12 to provide optimum accuracy. This is accomplished through the use of adjustment member 114.

Adjustment Member:

In one arrangement measuring bodies 18 include an adjustment member 114. Adjustment member 114 is formed of any suitable size, shape and design and is configured to facilitate calibration of the indicia 112 of measuring tape 20 to the combined length of track 12 and measuring body 18, or more specifically, from the cutting edge 28 to the forward surface of the lower section 110 of stop feature 98 of measuring tape 20. In the arrangement, shown, as one example, adjustment member 114, when viewed from above or below is a generally L-shaped member with a first leg 116 that is configured to attach to housing 64 of measuring body 18, and a second leg 118 that is configured to extend across the measuring tape 20 thereby providing the accurate reading of the measurement.

In the arrangement shown, as one example, first leg 116 of adjustment member 114 extends along the lower exterior side of housing 62 and connects to housing 62 through connection to fastener 120 that screws into a hole in housing 62. To provide adjustability, fastener 120 extends through a slot 122 that allows forward-to-back adjustment of adjustment member 114. To adjust the position of adjustment member 114, fastener 120 is loosened and the adjustment member 114 is moved forward or back the desired distance and then fastener 120 is tightened thereby locking adjustment member 114 in its calibrated position.

To provide additional alignment, first leg 116 includes a second slot 123 that receives an alignment member 121 therein, which in the arrangement shown, is a post that extends outward from housing 62 and fits within second slot 123. The presence of second slot 124 and alignment member 126 helps to maintain the forward-to-back alignment of adjustment member 114 while allowing for adjustment of the position of the adjustment member 114.

In the arrangement shown, as one example, second leg 118 extends in approximate perpendicular alignment to the first leg 116. In the arrangement shown, second leg 118 extends over the upper surface of measuring tape 20 in an approximate perpendicular alignment to the length of measuring tape 20. Second leg 118 is configured to indicate the precise and calibrated measurement by reading the indicia 112 on measuring tape 20 at the rearward side of second leg 118. To ensure the reading is made at the rearward side of second leg 118, the upper end of second leg 118 curves toward measuring body 18 thereby shrouding a portion of the measuring tape 20.

Calibration:

As one example, measuring bodies 18, and more specifically measuring tape 20, is calibrated to track 12 by first connecting measuring body 18 to track 12 by inserting nuts 90 and guides 80 of connection section into the T-slot of second protrusion 38 and moving the measuring body 18 to the desired position on the track 12. Once measuring body 18 is in the desired position, nuts 90 are tightened in place by rotating knob 92 thereby locking the measuring body 18 in place on the track. Next, the measuring tape 20 is extended a distance rearward from the measuring body 18. Next, the distance from the interior surface of lower section 110 of stop feature 98 to cutting edge 28 is precisely measured using a measuring device, such as a ruler, tape measure or the like. Next, the adjustment member 114 is precisely adjusted by first loosening fastener 120 and sliding the adjustment member 114 forward or rearward until the precise measurement is read adjacent the rearward side of the second leg 118 that extends over the measuring tape 20 at which point the fastener 120 is tightened thereby precisely calibrating the measuring tape 20 to the track 12.

Locking Member:

To make repeatable cuts it is important for the measuring tape 20 to remain in a set position. Said another way, to ensure multiple cuts are made at the same length, it is important to ensure that the measuring tapes 20 are locked in place and do not unintentionally move between cuts. To accomplish this, substantial clamping pressure is applied to measuring tape 20 through locking member 124.

In one arrangement measuring bodies 18 include a locking member 124. Locking member 124 is formed of any suitable size, shape and design and is configured to facilitate locking of measuring tape 20 in place so as to prevent unintentional movement of measuring tape 20 so as to facilitate repeatable cuts. In the arrangement, shown, as one example, locking member 124 includes an arm 126 that extends from a first end 128 to a second end 130. Arm 126 is connected to the exterior of housing 62 by fastener 132. In the arrangement shown, as one example, fastener 132 extends through the first end 128 and into housing 62 thereby forming an axis of rotation for arm 126. The first end 128 of arm 126 is positioned near the rearward lower end of the housing 62 in a side of housing 62.

Arm 126 rotates between a raised, or disengaged, or unlocked position, and a lowered, or engaged, or locked position. In the arrangement shown, as one example, arm 126 includes a protrusion 134 that slides within a curved groove 136 in the exterior surface of housing 62. Protrusion 134 is received within and held by a recess 138 at the fully raised position and the fully lowered position, which corresponds to an unlocked position and a locked position, respectively. In this way, the insertion of protrusion 134 within a recess 138 helps to hold the arm 126 in the fully locked position and the fully unlocked position.

Arm 126 connects to axle 140 positioned within the hollow interior 68 of housing 62 of measuring bodies 18. As arm 126 is rotated, so rotates axle 140. Axle 140 is formed of any suitable size, shape and design and is configured to translate rotation of arm 126 to locking pressure onto measuring tape 20. In the arrangement shown, as one example, axle 140 extends across the side 58 to side 60 width of housing 62 at or near the rearward lower side of housing 62. In the arrangement shown, as one example, the outward ends of axle 140 are held within a collar 142 on each side of housing 62 which provides alignment to axle 140 and allows rotation of axle 140 therein. In one arrangement, the collar 142 positioned opposite arm 126 includes stops 144 therein that engage and stop a protrusion 146 in axle 140 when axle 140 is in a fully locked position and a fully unlocked position.

In the arrangement shown, as one example, axle 140 is a generally cylindrically shaped member that extends a length between opposing ends. To impart locking pressure upon measuring tape 120, in the arrangement shown, as one example, axle 140 includes a cam surface 148 that extends outward from the generally cylindrical body of axle 140. As axle 140 is rotated in the locked position, cam surface 148, which protrudes outward and downward upon brake shoe 150 which engages measuring tape 20.

Brake shoe 150 is formed of any suitable size, shape and design and is configured to engage and facilitate locking of measuring tape 20 in a desired position. In the arrangement shown, as one example, brake shoe 150 has a generally flat upper surface 152 that is engaged by cam surface 148 of axle 140 when rotated thereby causing downward pressure on brake shoe 150. This causes brake shoe 150 to engage and lock measuring tape 20 in place. In the arrangement shown, as one example, the forward end of brake shoe 150 includes an axle 154 that extends outward from each side of brake shoe 150. These axles are held within a collar 156 in the interior surface of opposing housing halves 64. In this way, the connection of axle 154 to the collar 156 in housing 62 facilitates pivoting of the forward end of brake shoe 150 when the rearward end of brake shoe 150 is pressed down by cam surface 148 of axle 140.

Brake shoe 150 includes a lower surface 158 that includes one or more pads 160 therein. When viewed from an end, the lower surface 158 of brake shoe 150 has a generally arcuate shape that matches the curvature of the upper surface of measuring tape 20. In this way, when brake shoe 150 is pressed down, the lower surface 158 of brake shoe 150 engages a substantial surface area of the upper surface of measuring tape 150. This increased surface area provides increased locking of the measuring tape 20 in place.

To provide maximum durability and strength and rigidity and ruggedness, the main body of brake shoe 150 (which in one arrangement is all portions of the brake shoe 150 except pads 160) is formed of a hard material such as a metallic material, a plastic material, composite material, a nylon material, a fiber glass material an UHMW material, or any other non-metallic material, or combination thereof. While hard materials are good for durability, strength, rigidity and ruggedness, hard materials tend to have a low coefficient of friction. That is, hard materials tend to slide easily when engaged with other components. The easier the brake shoe 150 slides on measuring tape 20, the more pressure must be applied to keep the measuring tape 20 in place when locking member 124 is in a locked position. To correct this problem, pads 160 are placed in the lower surface 158 of brake shoe 150 which engage measuring tape 20. The material that pads 160 are formed of has a higher coefficient than the material that forms the main body of brake shoe 150.

The term coefficient of friction describes the ratio of the force of friction between two bodies and the force pressing them together. The higher the coefficient of friction, the more force is required to cause the two bodies to slide with respect to one another. One drawback to using a material that has a high coefficient of friction, such as a compressible rubber or composite material, is that the higher the coefficient of friction the less-durable the material tends to be and/or the more malleable the material tends to be. As such, by forming the main body of brake shoe 150 of a harder material that is strong and durable (but has a lower coefficient of friction) and placing a pads 160 of a high coefficient of friction material on the lower surface 158 that has a higher coefficient of friction is the best of both worlds in that this provides a brake shoe 150 that is hard and durable while also having a high coefficient of friction imparted upon measuring tape 20 when brake shoe 150 is in a locked position. By adding the pads 160 on the lower surface 158 this allows a user to apply less pressure on the measuring tape 20, or said another way, this allows the user to hold measuring tape 20 with a greater level of force, or said yet another way, this allows measuring tape 20 to be held in a manner that resists movement greater than without the use of pads 160. This ensures that once the length of measuring tapes 20 are set, the position of measuring tapes 20 will not unintentionally move thereby allowing the track 12 to be used to cut multiple workpieces 22 at the same length without fear of movement.

The grip material of pads 160 may be attached to the lower surface 158 of brake shoe 150 by any manner, method or means. In one arrangement, grip material of pads 160 is adhered to the lower surface 158 of brake shoe 150. In another arrangement, grip material is molded into or onto the lower surface 158 of brake shoe 150 in a dual-molding or dual durometer manner. Grip material may be sprayed onto or deposited onto the lower surface 158 of brake shoe 150. Grip material may be added to lower surface 158 of brake shoe 150 by any other manner, method or means.

To increase grip upon measuring tape 20, in one arrangement, the lower surface of measuring tape 20, just below the point where brake shoe 150 engages the upper surface of measuring tape 20 passes through a cradle 162 that closely matches the curvature of the lower surface of measuring tape 20 thereby increasing the area of engagement between measuring tape 20 and housing 62 when brake shoe 150 is engaged. In one arrangement, the upper surface of cradle 162 also or alternatively has pads or a layer of material that has a high coefficient of friction, like that described herein with respect to pads 160. In this way, when brake shoe 150 is depressed into measuring tape 20, the lower surface 158 of brake shoe 150, as well as pads 160, engages the upper surface of measuring tape 20, and the lower surface of measuring tape 20 engages the upper surface of cradle 162. In this way, the position of measuring tape 20 is locked between brake shoe 150 and cradle 162 when locking member 124 is in a locked position.

In Operation:

When track 12 is to be used to cut wide workpieces 22, one, two or more measuring bodies 18 are installed on track 12 by aligning the connection section 72 of the front end 50 of measuring bodies 18 with the T-slot of the non-cutting edge 30 of track 12. More specifically, the nuts 90 and guides 80 are aligned with and inserted into an open end of the T-slot of second protrusion 38. In this position, the forward surface 78 of connection section 72 is in flat and flush engagement with the non-cutting edge 30 of track 12, and the lower surface 76 of connection section 72 is in flat and flush engagement with the upper surface of second protrusion 38. In this position, measuring bodies 18 are slid along the T-slot of second protrusion 38 until they reach their desired position along track 12, which in many cases is the widest possible position that workpiece 22 and track 12 will allow.

Once the measuring bodies 18 are at their desired position on track 12, measuring bodies 18 are locked in place by rotating knobs 92 of tightening member 82 which pulls the nuts 90 upward and into engagement with the lower surface of the narrower section of the T-slot of second protrusion 38 thereby frictionally locking measuring body 18 in place along the T-slot of second protrusion 38.

Once measuring bodies 18 are locked in place, assuming the measuring bodies 18 are calibrated to track 12 (if measuring bodies 18 are not calibrated to track 12, the calibration procedure presented herein is performed), the measuring bodies 18 are set to the desired cut width by moving the locking member 124 to an unlocked or disengaged position. This is accomplished by rotating the second end 130 of arm 126 of locking member 124 upward. This causes axle 144 to rotate which causes the cam surface 148 of axle 140 to disengage the upper surface 152 of brake shoe 150. This causes the lower surface 158 and pads 160 of brake shoe 150 to disengage the upper surface of measuring tape 20. This causes the lower surface of measuring tape to disengage the upper surface of cradle 162. In this position, measuring tape 20 is free to be deployed.

When measuring tape 20 is free to be deployed, the user pulls the end of measuring tape 20 outward and rearward from the lower rearward side of measuring body 18. The precise length of measuring tape 20 is determined by reading the indicia 112 in the upper surface of measuring tape 20 at the second leg 118 of adjustment member 114. Once measuring tape 20 is in the desired position, the second end 130 of arm 126 of locking member 134 is rotated downward. This downward rotation of the second end 130 of arm 124 causes protrusion 134 to move downward within groove 136. This downward rotation of the second end 130 of arm 126 causes rotation of axle 140. As axle 140 rotates, this causes the cam surface 148 to engage the upper surface 152 of brake shoe 154. As the cam surface 148 of axle 140 engages the upper surface 152 of brake shoe 154 this causes brake shoe 150 to rotate upon the axles 154 held with the collars 156 of housing halves 64. As the second end 130 of arm 124 is increasingly rotated downward, this increasingly causes cam surface 148 to engage the upper surface 152 of brake shoe 150, this causes the rearward side of brake shoe 150 to increasingly move downward as the axles 154 rotate within collars 156. This causes the lower surface 158 and pads 160 of brake shoe 150 to engage the upper surface of measuring tape 20. This downward pressure from the lower surface 158 and pads 160 of brake shoe 150 on the upper surface of measuring tape 20 causes the lower surface of measuring tape 20 to engage the upper surface of cradle 162. In this way, measuring tape 20 is captured between cradle 162 and brake shoe 150, thereby locking it in place.

As the second end 130 of arm 126 of locking member 124 is increasingly rotated downward, the pressure applied to measuring tape increases until the second end 130 of arm 126 of locking member 124 reaches its fully downward position, or the fully engaged position or fully locked position. In this fully locked position, the protrusion 134 engages the recess 138 in groove 136, thereby locking the arm 126 in the fully lowered and locked position. Also, in this fully locked position, the cam surface 148 of axle 140 engages the upper surface 152 of brake shoe 150 at its tangent point, or at a land, flat section or other stall area. Engagement of the upper surface 152 of brake shoe 150 by a tangent point or land eliminates any urge to rotate backward or toward the disengaged or unlocked positon. As such, force must be applied to move locking member 124 from this locked position to an unlocked positon.

In the locked position, measuring tape 20 is locked in place at maximum force. In addition, due to the presence of the high coefficient of friction material on the pads 160 (as well as in some arrangements in the cradle 162) measuring tape 20 is held in place with a high level of friction, or said another way, it takes a substantial amount of force to pull measuring tape 20 out of the position that it is locked in. This high level of friction allows multiple cuts to be made using track 12 and measuring bodies 18 without fear that the measuring tapes 20 will move once set in place using locking member 124.

Before making a first cut, the desired measurement may be tested by measuring from the cutting edge 28 to the interior surface of the lower section 110 of stop feature 98, which should precisely read the desired width of cut for workpiece 22.

Once measuring tapes 20 are set in place and locking member is engaged, track 12 may be placed on a workpiece 22 to perform a cutting operation. When moving track 12, due to the strength and rigidity of measuring tapes 20, even when at their fully deployed length measuring tapes 20 extend outward from measuring body 18 and do not collapse. This allows for the easy placement of track 12 and measuring bodies 18 on workpiece 22. That is, the lower surface 24 of track 12 is placed on the upper surface of workpiece 22. The track 12 is slid on the workpiece 22 until the forward surface of lower section 110 of stop feature 98 of the measuring bodies 18 engage the edge of workpiece 22. Once in this position, the workpiece 22 is ready to cut.

The user places the guide 16 of saw 14 on the track 12 such that the features of the guide 16 mate with the features of the track 12 and the saw is powered and slid across the length of track 12 thereby cutting the workpiece at the cutting edge 28. Once the first workpiece 22, the track 12 may simply be raised off of the workpiece 22 and placed on the next workpiece 22 and the same cutting operation may be performed. Due to the high strength of hold on the measuring tapes 20 the track 12 may be used to cut multiple workpieces 22 without fear of the measuring tapes 20 moving.

As one example, conventional tape measures often have minimal pull out force that often ranges below one pound of pull out force, or below two pounds of pull out force when their tape is in the locked position. In some arrangements presented herein, the pull out force may exceed five pounds of pull out force, or be in the range of five pounds to ten pounds of pull out force. In one arrangement, the pull out force may exceed ten pounds of pull out force. In one arrangement, the pull out force may exceed fifteen pounds of pull out force. In one arrangement, the pull out force may exceed twenty pounds of pull out force. In one arrangement, the pull out force may exceed twenty five pounds of pull out force. In one arrangement, the pull out force may range between five and ten pounds of pull out force. In one arrangement, the pull out force may range between five and fifteen pounds of pull out force. In one arrangement, the pull out force may range between five and twenty pounds of pull out force. In one arrangement, the pull out force may range between five and twenty five pounds of pull out force. Any other range is hereby contemplated for use.

Figure 21:
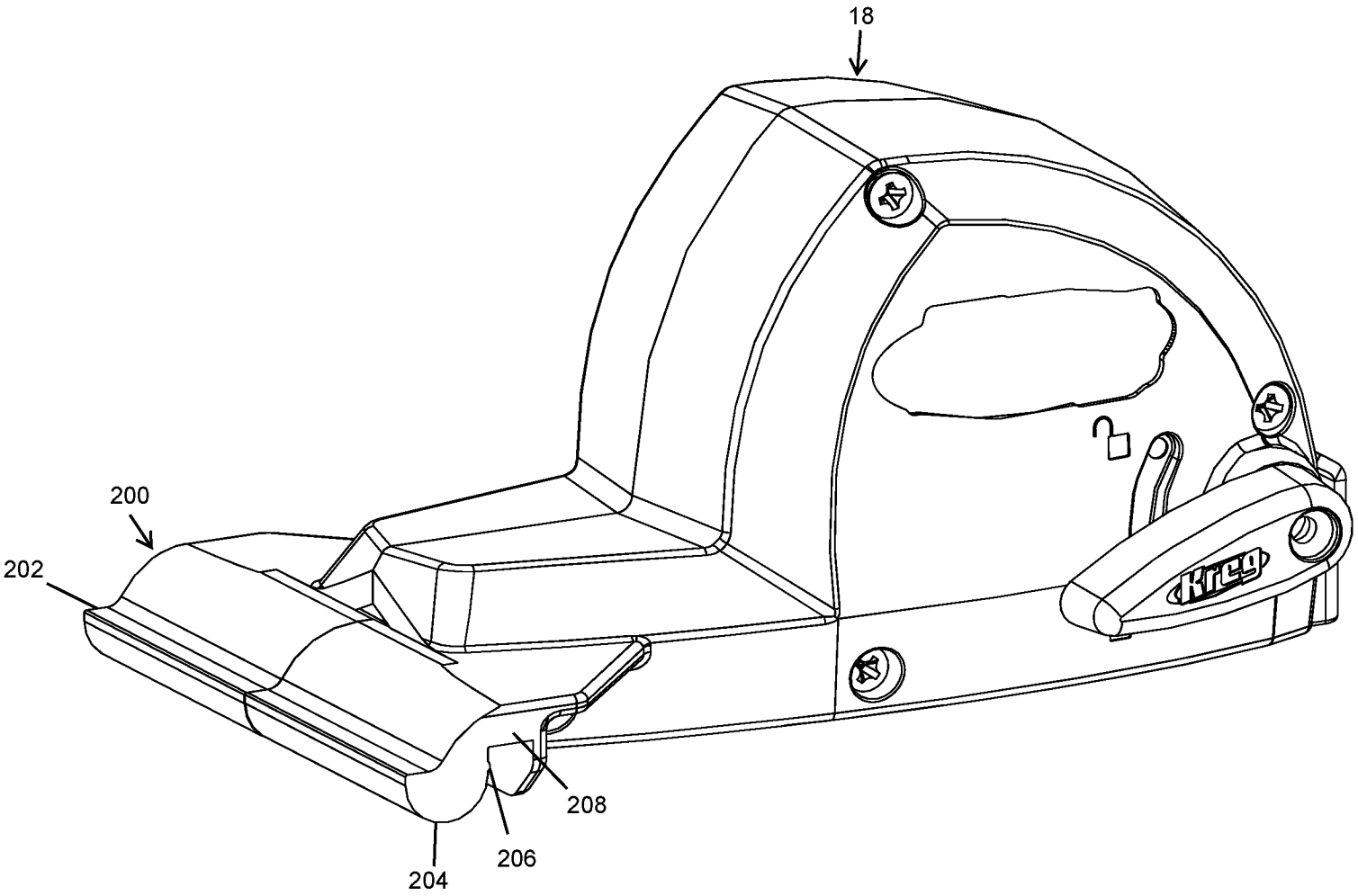
FIG. 21 is a perspective view of a measuring body of a parallel guide cutting system having an alternative embodiment connection section that includes a snap feature that frictionally fits within the slot adjacent the non-cutting edge of the track.
Figure 22:
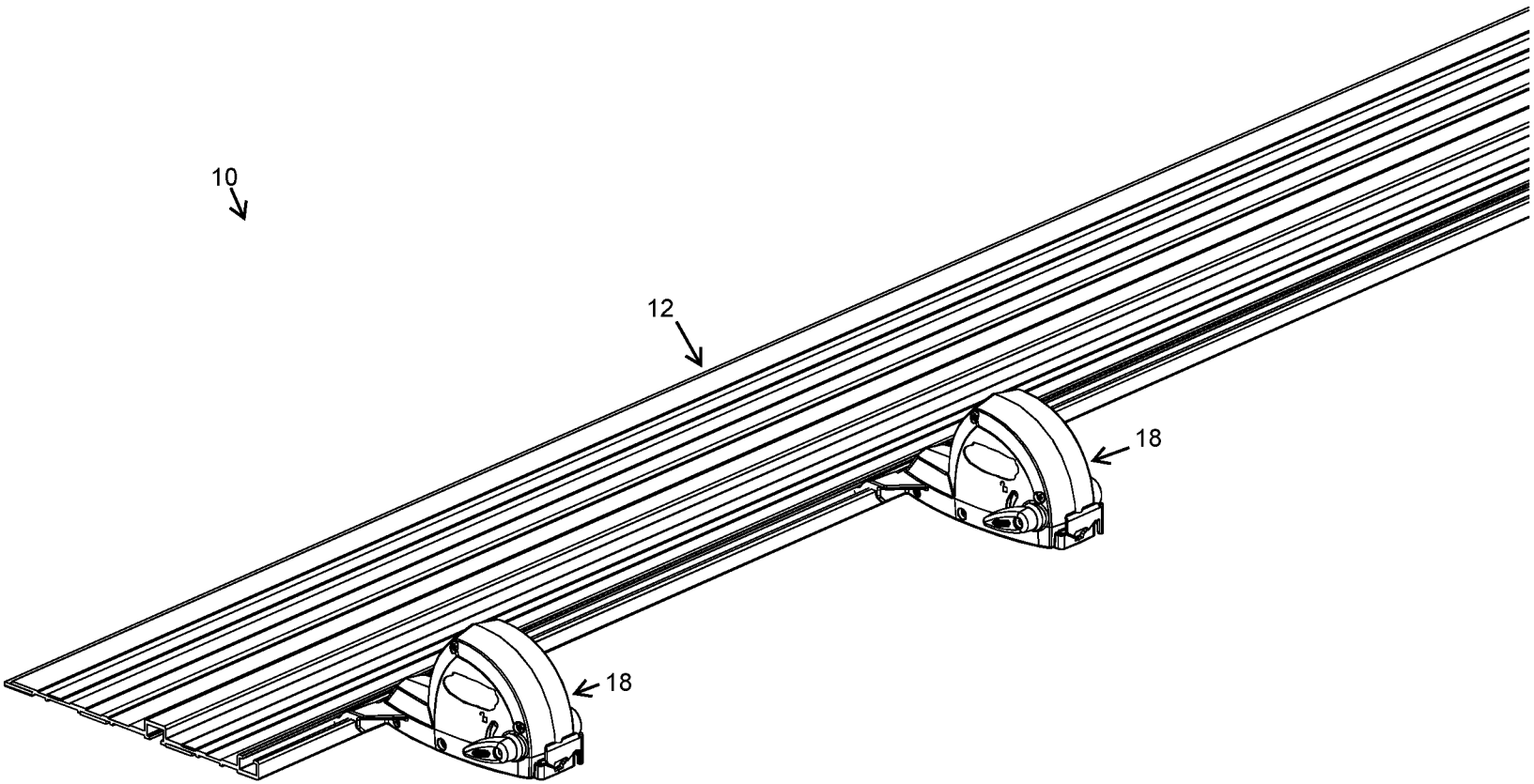
FIG. 22 is a perspective view of a track having a pair of measuring bodies having an alternative embodiment connection section that includes a snap feature that frictionally fits within the slot adjacent the non-cutting edge of the track, the view showing the pair of measuring bodies attached adjacent the non-cutting side of the track.
Figure 23:
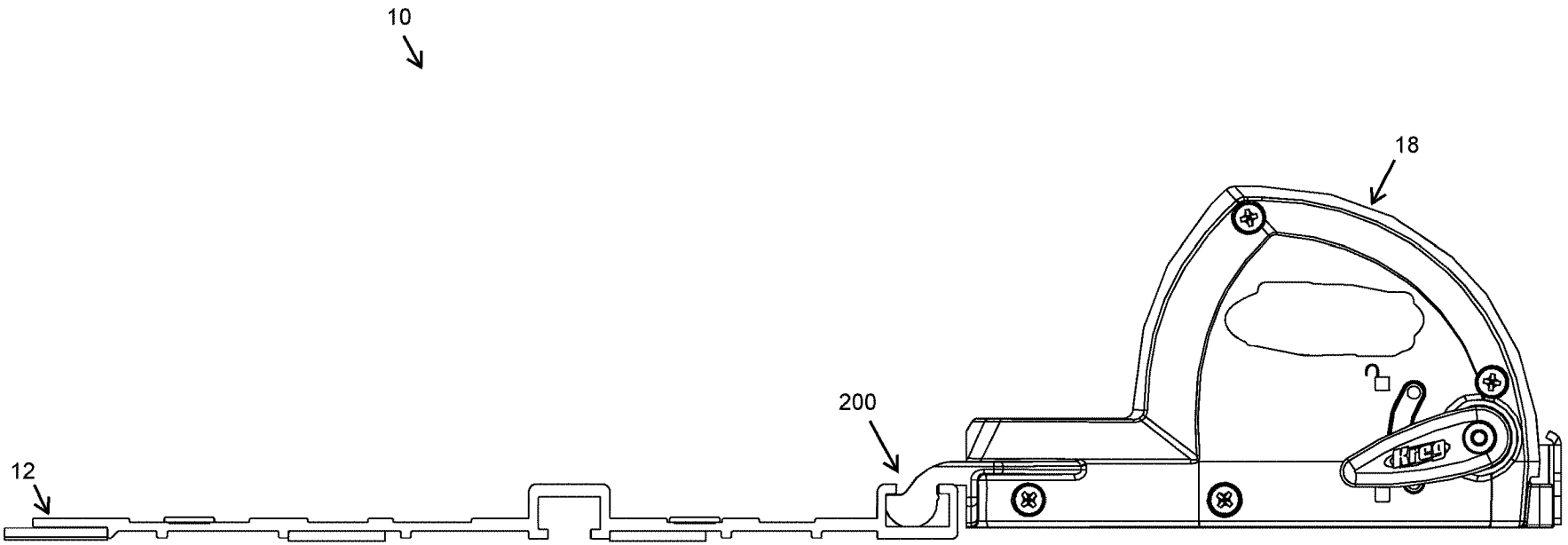
FIG. 23 is a side elevation view of a track having a pair of measuring body having an alternative embodiment connection section that includes a snap feature that frictionally fits within the slot adjacent the non-cutting edge of the track, the view showing the pair of measuring bodies attached adjacent the non-cutting side of the track, the view showing the snap feature positioned within and frictionally locked to the slot of the track.
Figure 23A:
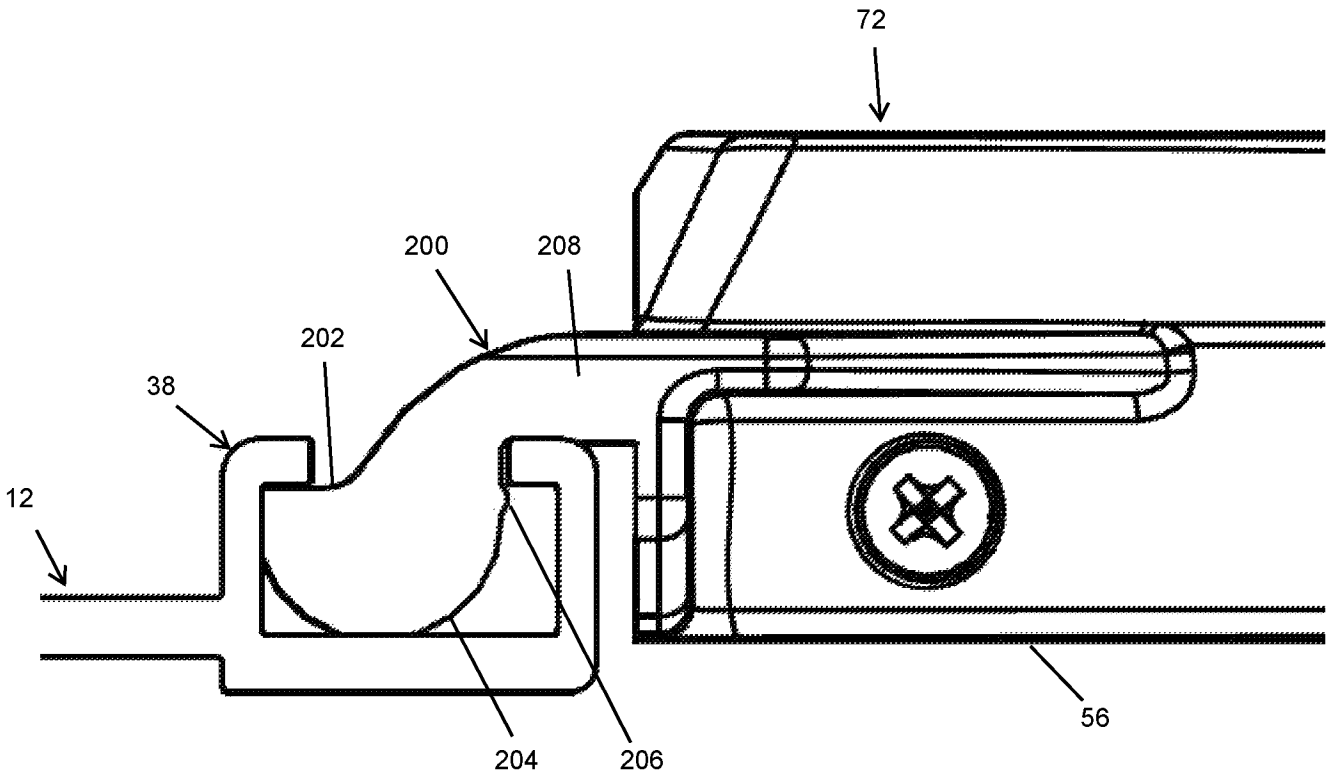
FIG. 23A is a close-up side elevation view of the snap feature positioned within and frictionally locked to the slot of the track as is shown in FIG. 23, the view showing the forward upper side of the snap feature frictionally engaged with lower surface of the forward side of the slot of the non-cutting side of the track, the view showing the forward side of the snap feature frictionally engaged with the interior surface of the forward side of the slot of the non-cutting side of the track, the view showing the lower side of the snap feature frictionally engaged with the upper facing surface of the center wall of the slot of the non-cutting side of the track, the view showing the detent of the snap feature frictionally engaged just below the lower side of the rearward side of the slot of the track thereby locking the snap feature into the slot.
Figure 24:
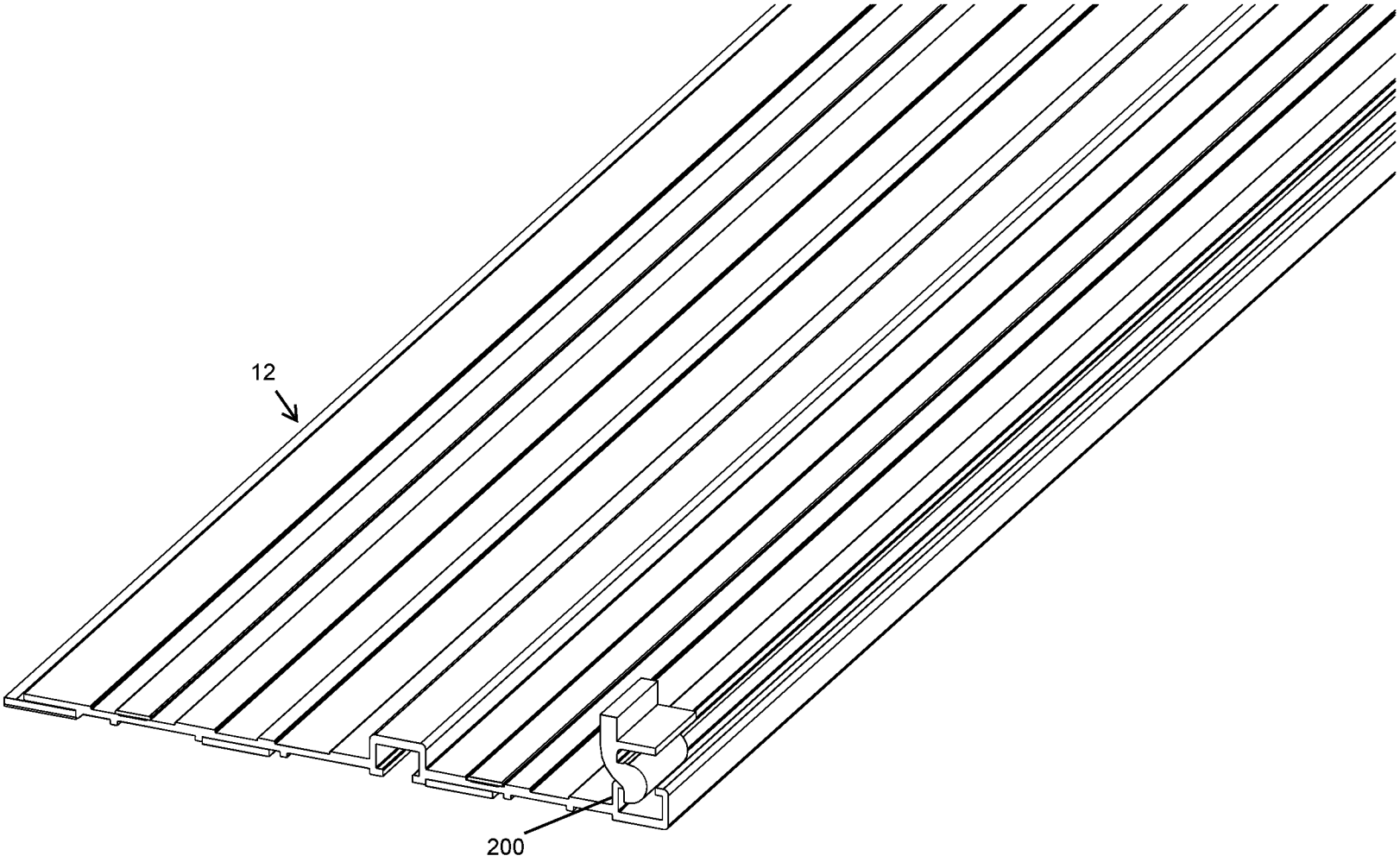
FIG. 24 is a perspective view of the snap feature shown in FIGS. 21-23, the view showing the forward end of the snap feature positioned within the slot of the track in the non-cutting side of the track, the view showing the rearward end of the snap feature in a raised position so as to facilitate the insertion of the front tip into the slot before the rearward side of the snap feature is lowered into the slot of the track.
Figure 25:
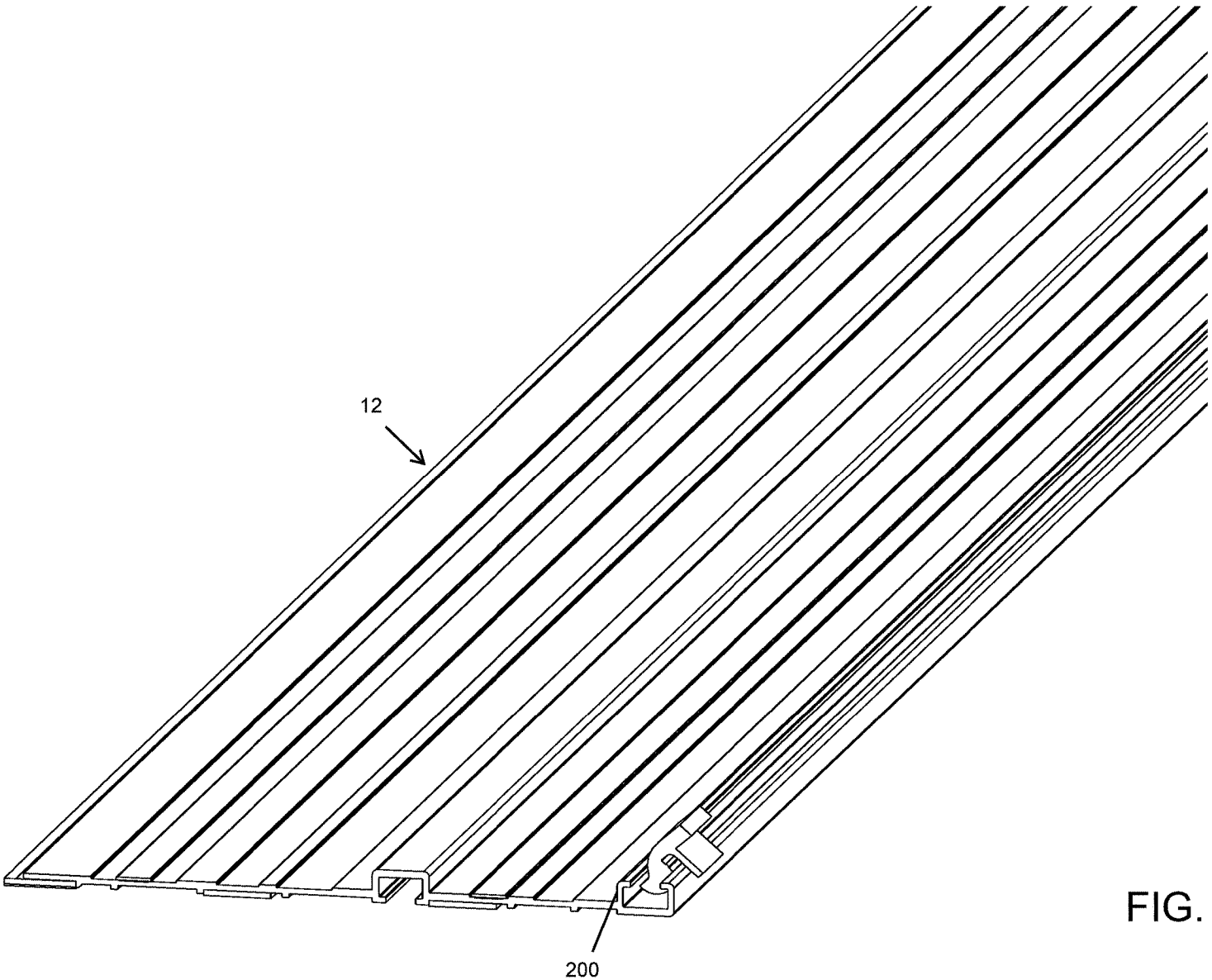
FIG. 25 is a perspective view of the snap feature shown in FIGS. 21-24, the view showing the forward end of the snap feature positioned within the slot of the track in the non-cutting side of the track, the view showing the rearward end of the snap feature in a partially lowered position after the front tip was lowered into the slot.
Figure 26:
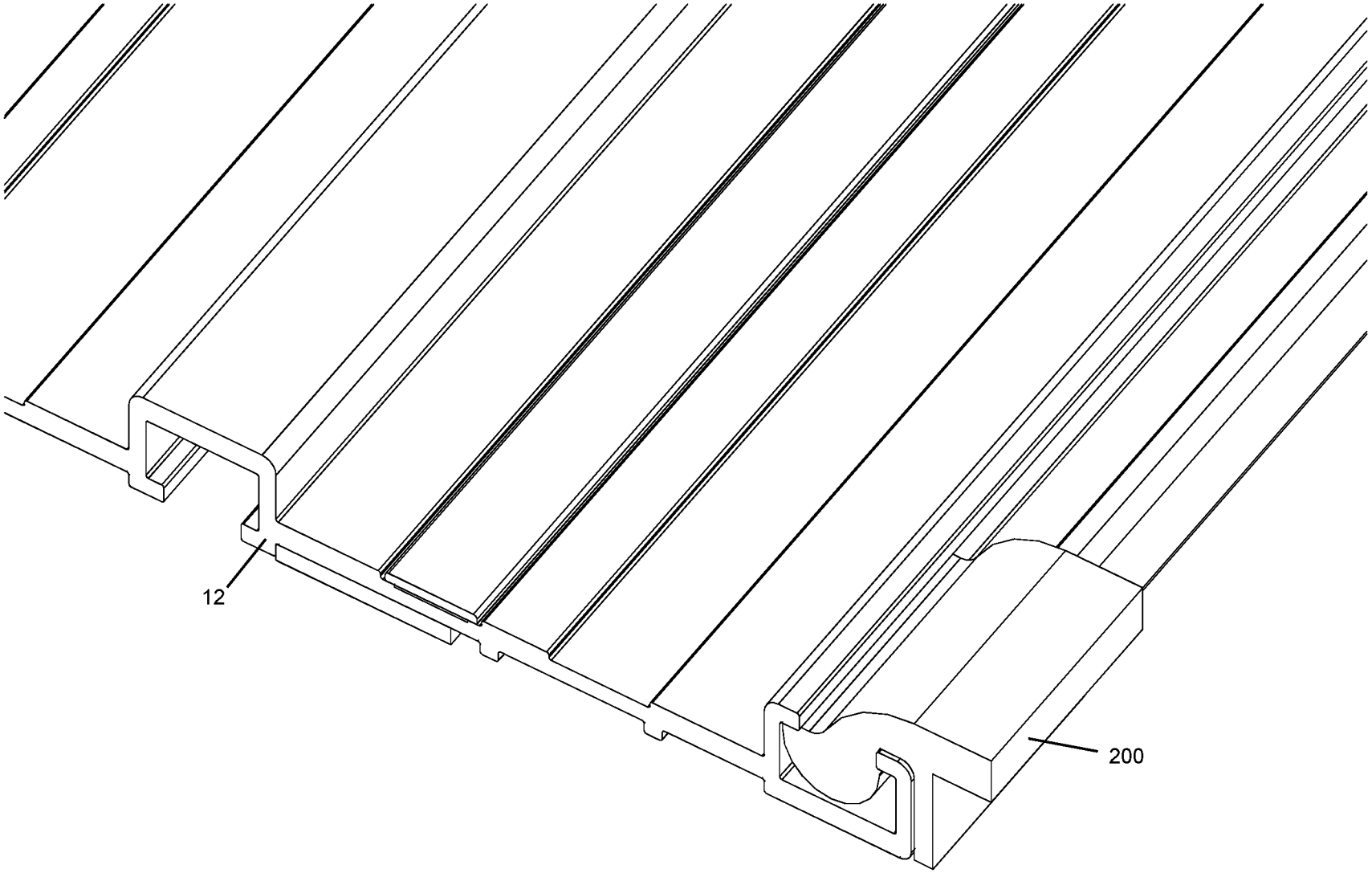
FIG. 26 is a perspective view of the snap feature shown in FIGS. 21-25, the view showing the forward end of the snap feature positioned within the slot of the track in the non-cutting side of the track, the view showing the rearward end of the snap feature in a fully lowered position after the front tip was lowered into the slot.

Alternative Arrangement—Snap Feature:

In an alternative arrangement, with reference to FIG. 21 through FIG. 26 connection section 72 includes a snap feature 200. Snap feature 200 is formed of any suitable size, shape and design and is configured to connect measuring bodies 18 to track 12 by insertion into the T-slot of second protrusion 38. In the arrangement shown, as one example, snap feature 200, when viewed from the side, as a flat upper surface 202 positioned at its forward end that connects to a rounded lower surface 204. A detent 206 is positioned at upper rearward edge of the lower surface 204 and protrudes outward therefrom a slight distance. Snap feature 200 includes an arm 208 that extends rearward from flat upper surface 202 a distance and facilitates connection to the front side 50 of measuring body 18.

In this arrangement, snap feature 200 is configured to fit within the T-slot of second protrusion 38 with close and tight frictional engagement such that when snap feature 200 is inserted within the T-slot of second protrusion 38, measuring body 18 is locked in place on track 12.

More specifically, in the arrangement shown, as one example, to install measuring body 18 on track 12 using snap feature 200, the measuring body 18 is moved to any position along the length of track 12. Once measuring body 18 is in the desired position along the length of track 12, the forward end of snap feature 200 is inserted within the narrow upper section of the T-slot of second protrusion 38. Next, once in this position, the rear side 52 of measuring body 18 is rotated downward until the snap feature 200 is fully inserted into and locked onto the T-slot of the second protrusion 38.

When snap feature 200 is fully inserted into and locked onto the T-slot of the second protrusion 38, the forward end of the flat upper surface 202 engages the lower surface of the forward lip that forms the narrow upper section of the T-slot of the second protrusion 38 in a flat and flush engagement. Also, when snap feature 200 is fully inserted into and locked onto the T-slot of the second protrusion 38, the forward end of the lower surface 204 of snap feature 200 engages the rear facing sidewall of the T-slot of the second protrusion 38 in a flat and flush engagement. Also, when snap feature 200 is fully inserted into and locked onto the T-slot of the second protrusion 38, the lower end of the lower surface 204 of snap feature 200 engages the upper surface of the bottom wall of the T-slot of the second protrusion 38 in a flat and flush engagement. Also, when snap feature 200 is fully inserted into and locked onto the T-slot of the second protrusion 38, the detent 206 of the lower surface 204 of snap feature 200 engages and extends just below the lower surface of the rearward lip that forms the narrow upper section of the T-slot of the second protrusion 38 in a flat and flush engagement. Also, when snap feature 200 is fully inserted into and locked onto the T-slot of the second protrusion 38, the lower surface of arm 208 of snap feature 200 engages the upper surface of the rearward lip that forms the narrow upper section of the T-slot of the second protrusion 38 in a flat and flush engagement.

In this way, snap feature 200 allows for the quick, easy and secure manner of attaching measuring body 18 to track 12.

To remove measuring body 18 from track 12 when using snap feature 200, the rear side 52 of measuring body 18 is simply raised, thereby causing snap feature 200 to come out of the T-slot of second protrusion 38.

T-Stop Arrangement:

While two measuring bodies 18 are shown in simultaneous use in the figures, it is hereby contemplated that a single measuring body 18 may be used. In one arrangement, when using only a single measuring body 18, to provide improved or optimum alignment of workpiece 22 an elongated stop feature 98 is positioned at the end of measuring tape 20. This elongated stop feature 98 is what is often known as a T-stop, which has an elongated forward facing surface that extends in a generally perpendicular manner to the length of measuring tape 20 and extends in a generally parallel spaced manner to the cutting edge 28 of track 12. This elongated surface or edge of the T-stop feature of stop feature 98 is configured to engage an edge of workpiece 22 and thereby provide parallel alignment of workpiece 22 to track 12 using only a single measuring body 18. With that said, multiple measuring bodies 18 having this T-stop alignment feature may simultaneously be used, which has the tendency of providing increased alignment.

From the above discussion it will be appreciated that the improved parallel guide cutting system 10 and related methods of use, presented herein improves upon the state of the art.

Specifically, the improved parallel guide cutting system 10 and related methods of use presented: provides accurate cuts on wide sheets of material; is safe to use; is efficient to use; is relatively inexpensive; is capable of making long straight cuts; can be used to cut wide sheets of material easily and accurately; is accurate; is efficient; provides precise alignment; can be used with workpieces with a wide range of thicknesses; is easy to learn how to use; is relatively small in size and shape; provides the benefits of a circular saw and a table saw in a single device; holds workpieces in a firm and secure manner; is easy to set up; is easy to take down; is formed of a minimum number of parts; is simple to use; is easier to use than prior art systems; is unique; collapses and is easy to store; is light weight; is high quality; has a robust design; has a long useful life; provides accurate and clean cuts; helps prevent chip tear-out; is durable; saves time; is fun to use; can be used with workpieces of practically any material; can be used on a job site; makes it easier to measure for cuts on wide workpieces and sheets of material; makes measuring more repeatable than prior art systems; reduces or eliminates the need for a helper when making cuts; and that firmly locks the measuring tape in place so as to allow repeatable cuts, among countless other advantages and improvements.

It will be appreciated by those skilled in the art that other various modifications could be made to the device without parting from the spirit and scope of this invention. All such modifications and changes fall within the scope of the claims and are intended to be covered thereby.

What is claimed:

1. A system for cutting wide workpieces with a saw, comprising:

a track;

the track extending a length from a first end to a second end;

the track extending a width from a cutting edge and a non-cutting edge;

the track having an upper surface;

the track having a feature in the upper surface extending along at least a portion of the length of the track;

wherein the feature is a protrusion extending upward from the upper surface or a recess extending downward from the upper surface;

wherein the feature of the track is configured to receive and guide the saw along at least a portion of the length of the track;

a first measuring body and a second measuring body;

the first measuring body and second measuring body having a front side and a rear side;

the first measuring body and second measuring body operably connected to the track adjacent their front side;

the first measuring body and the second measuring body having a spool of measuring tape, wherein the measuring tape extends outwardly from their rear side;

wherein the measuring tape of the first measuring body and the second measuring body is configured to move between a retracted position and an extended position;

the first measuring body and second measuring body having a locking member that is configured to lock their measuring tape in an extended position.

2. The system of claim 1, wherein when the track is placed on a workpiece, the measuring tape of the first measuring body and second measuring body are extended to measure the width of the workpiece.

3. The system of claim 1, further comprising the measuring tape of the first measuring body and second measuring body having measuring indicia and a stop feature.

4. The system of claim 1, wherein the measuring tape of the first measuring body and second measuring body accommodates for the width of the track and the measuring body so as to provide an accurate measurement of the distance from the cutting edge of the track to a stop feature of the measuring tape.

5. The system of claim 1, wherein the first measuring body and second measuring body connect to a slot that extends along the non-cutting edge of the track.

6. The system of claim 1, wherein the first measuring body and second measuring body slide along a slot that extends along the non-cutting edge of the track.

7. The system of claim 1, wherein the first measuring body and second measuring body include an adjustment member, wherein the adjustment member facilitates fine tuning of the measurement of the distance from the cutting edge of the track to a stop feature of the measuring tape.

8. The system of claim 1, wherein the measuring tape of the first measuring body and second measuring body are spring biased to retract within the measuring body.

9. The system of claim 1, wherein the first measuring body and second measuring body further include a brake shoe positioned within the measuring body, wherein the brake shoe includes at least one pad that is formed of a compressible material having a first coefficient of friction to increase locking force on the measuring tape, the brake shoe includes a main body formed of a material having a second coefficient of friction;

wherein the first coefficient of friction is higher than the second coefficient of friction.

10. The system of claim 1, wherein the first measuring body and second measuring body include a locking member connected to the measuring body, wherein the locking member moves between a locked position, wherein the measuring tape is locked in place, and an unlocked position, wherein the measuring tape is free to move between a retracted position and an extended position.

11. The system of claim 1, wherein the locking member is connected to the measuring body, the locking member having a cam surface that operates to increase locking force on the measuring tape.

12. A system for cutting wide workpieces with a saw, comprising:

a track;

the track extending a length from a first end to a second end;

the track extending a width from a cutting edge and a non-cutting edge;

the track having an upper surface;

the track having a feature in the upper surface and extending along at least a portion of the length of the track;

wherein the feature is a protrusion extending upward from the upper surface or a recess extending downward from the upper surface;

wherein the feature of the track is configured to receive and guide the saw along at least a portion of the length of the track;

a first measuring body and a second measuring body;

the first measuring body and second measuring body having a front side and a rear side;

the first measuring body and second measuring body operably connected to the track adjacent their front side;

the first measuring body and the second measuring body having a spools of measuring tape that extends outwardly from their rear side;

wherein the measuring tape of the first measuring body and the second measuring body is configured to move between a retracted position and an extended position;

the first measuring body and second measuring body having a brake shoe having a main body and at least one pad;

wherein the first measuring body and second measuring body include a locking member connected to the measuring body, the locking member having a cam surface that engages the main body of the brake shoe;

wherein the cam surface of the locking member of the first measuring body and second measuring body is configured to press the brake shoe against the measuring tape and increase locking force applied by the brake shoe on the measuring tape when the locking member is rotated in a first direction to a first position;

wherein the cam surface of the locking member of the first measuring body and second measuring body is configured to decreases locking force applied by the brake shoe on the measuring tape when the locking member is rotated in a second direction to a second position;

the at least one pad of the brake shoe of the first measuring body and second measuring body attached to a lower surface of the main body;

wherein the main body of the brake shoe of the first measuring body and second measuring body compresses the at least one pad against the measuring tape when the locking member is rotated in the first direction to the first position;

wherein the at least one pad of the brake shoe of the first measuring body and second measuring body is formed of a compressible material having a first coefficient of friction to increase locking force on the measuring tape;

wherein the main body of the brake shoe of the first measuring body and second measuring body is formed of a material having a second coefficient of friction;

wherein the first coefficient of friction is higher than the second coefficient of friction.

13. The system of claim 12, wherein force is required to be applied to the locking member to rotate the cam surface of the locking member in the second direction away from the first position.

14. The system of claim 12, wherein the locking force applied by the brake shoe on the measuring tape is at least 5 pounds when the cam surface of the locking member is in the first position.

15. A system for cutting wide workpieces with a saw, comprising:

a track;

the track extending a length from a first end to a second end;

the track extending a width from a cutting edge and a non-cutting edge;

the track configured to receive and guide the saw;

a first measuring body;

the first measuring body having a front side and a rear side;

the front side of the first measuring body operably connected to the non-cutting edge of the track;

the rear side of the first measuring body having a measuring tape that extends outwardly from the rear side and is configured to move between a retracted position and an extended position;

the first measuring body having a spool wherein the measuring tape wraps around the spool;

the first measuring body having a locking member and a brake shoe;

the brake shoe having a main body and at least one pad;

wherein the locking member is configured to lock the measuring tape in place by moving the brake shoe to press the at least one pad against the measuring tape of the first measuring body;

wherein the at least one pad is formed of a material having a first coefficient of friction and the main body is formed of a material having a second coefficient of friction;

wherein the first coefficient of friction is higher than the second coefficient of friction.

16. The system of claim 15, further comprising the measuring tape of the first measuring body having measuring indicia and a stop feature.

17. The system of claim 15, wherein the measuring tape of the first measuring body accommodates for the width of the track and the first measuring body so as to provide an accurate measurement of the distance from the cutting edge of the track to a stop feature of the measuring tape.

18. The system of claim 15, wherein the first measuring body connects to a slot that extends along the non-cutting edge of the track.

19. The system of claim 15, wherein the first measuring body slides along a slot that extends along the non-cutting edge of the track.

20. The system of claim 15, wherein the first measuring body include an adjustment member, wherein the adjustment member facilitates fine tuning of the measurement of the distance from the cutting edge of the track to a stop feature of the measuring tape.

21. The system of claim 15, wherein the measuring tape of the first measuring body is spring biased to retract within the measuring body.

22. The system of claim 15, wherein the locking member moves between a locked position, wherein the measuring tape is locked in place, and an unlocked position, wherein the measuring tape is free to move between a retracted position and an extended position.

23. A system for cutting wide workpieces with a saw, comprising:

a track;

the track extending a length from a first end to a second end;

the track extending a width from a cutting edge and a non-cutting edge;

the track configured to receive and guide the saw;

a first measuring body;

the first measuring body having a front side and a rear side;

the front side of the first measuring body operably connected to the non-cutting edge of the track;

the rear side of the first measuring body having a spool of a measuring tape that extends outwardly from the rear side and is configured to move between a retracted position and an extended position;

the first measuring body having a locking member, wherein the locking member is configured to lock the measuring tape in place;

the first measuring body having a brake shoe positioned within the first measuring body;

wherein the brake shoe has a main body and at least one pad;

wherein the at least one pad is formed of a compressible material having a first coefficient of friction and the main body is formed of a material having a second coefficient of friction;

wherein the first coefficient of friction is higher than the second coefficient of friction;

wherein when the locking member is engaged, the measuring tape is engaged with the at least one pad thereby holding the measuring tape in place.

24. The system of claim 23, wherein when the locking member is engaged, the locking member presses against the brake shoe.

25. The system of claim 23, further comprising the measuring tape of the first measuring body having measuring indicia and a stop feature.

26. The system of claim 23, wherein the measuring tape of the first measuring body accommodates for the width of the track and the first measuring body so as to provide an accurate measurement of the distance from the cutting edge of the track to a stop feature of the measuring tape.

27. The system of claim 23, wherein the first measuring body connects to a slot that extends along the non-cutting edge of the track.

28. The system of claim 23, wherein the first measuring body slides along a slot that extends along the non-cutting edge of the track.

29. The system of claim 23, wherein the first measuring body include an adjustment member, wherein the adjustment member facilitates fine tuning of the measurement of the distance from the cutting edge of the track to a stop feature of the measuring tape.

30. The system of claim 23, wherein the measuring tape of the first measuring body is spring biased to retract within the measuring body.

31. The system of claim 23, wherein the locking member moves between a locked position, wherein the measuring tape is locked in place, and an unlocked position, wherein the measuring tape is free to move between a retracted position and an extended position.

32. A system for cutting wide workpieces with a saw, comprising:

a track;

the track extending a length from a first end to a second end;

the track extending a width from a cutting edge and a non-cutting edge;

the track configured to receive and guide the saw;

a first measuring body;

the first measuring body operably connected to the track adjacent the non-cutting edge;

the first measuring body having a first measuring tape;

the first measuring body having a spool wherein the first measuring tape wraps around the spool of the first measuring body;

the first measuring tape of the first measuring body having measuring indicia and a stop feature;

the first measuring tape of the first measuring body configured to move between a retracted position and an extended position;

wherein the measuring indicia of the first measuring tape of the first measuring body accommodates for the width of the track and the first measuring body so as to provide an accurate measurement of the distance from the cutting edge of the track to the stop feature of the first measuring tape.

33. The system of claim 32, wherein the first measuring body connects to a slot that extends along the non-cutting edge of the track.

34. The system of claim 32, wherein the first measuring body slides along a slot that extends along the non-cutting edge of the track.

35. The system of claim 32, further comprising an adjustment member connected to the measuring body, wherein the adjustment member facilitates fine tuning of the measurement of the distance from the cutting edge of the track to the stop feature of the measuring tape.

36. The system of claim 32, wherein the measuring tape of the first measuring body extends outward from a rear side of the measuring body.

37. The system of claim 32, wherein the first measuring body connects to the track at a front side of the first measuring body.

38. The system of claim 32, wherein the measuring tape is spring biased to retract within the first measuring body.

39. The system of claim 32, further comprising a locking member connected to the first measuring body, wherein the locking member moves between a locked position, wherein the first measuring tape is locked in place, and an unlocked position, wherein the first measuring tape is free to move between a retracted position and an extended position.

40. The system of claim 32, further comprising a locking member connected to the first measuring body, the locking member having a cam surface that operates to increase locking force on the first measuring tape.

41. The system of claim 32, further comprising a locking member connected to the first measuring body, the locking member having a cam surface that engages the brake shoe to increase locking force on the first measuring tape.

42. A system for cutting wide workpieces with a saw, comprising:

a track;

the track extending a length from a first end to a second end;

the track extending a width from a cutting edge and a non-cutting edge;

the track configured to receive and guide the saw;

a first measuring body;

the first measuring body operably connected to the track adjacent the non-cutting edge;

the first measuring body having a first measuring tape;

the first measuring body having a spool wherein the first measuring tape wraps around the spool of the first measuring body;

the first measuring tape of the first measuring body having measuring indicia and a stop feature;

the first measuring tape of the first measuring body configured to move between a retracted position and an extended position;

wherein the measuring indicia of the first measuring tape of the first measuring body accommodates for the width of the track and the first measuring body so as to provide an accurate measurement of the distance from the cutting edge of the track to the stop feature of the first measuring tape; and wherein the first measuring body includes an adjustment member configured to facilitate fine tuning of the measurement of the distance from the cutting edge of the track to the stop feature of the measuring tape.

* * * * *